US009240654B2

(12) United States Patent
Takemoto

(10) Patent No.: US 9,240,654 B2
(45) Date of Patent: Jan. 19, 2016

(54) CIRCUIT-TERMINAL CONNECTING DEVICE

(71) Applicant: DAI-ICHI SEIKO CO., LTD., Kyoto (JP)

(72) Inventor: Masatoshi Takemoto, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 14/457,516

(22) Filed: Aug. 12, 2014

(65) Prior Publication Data

US 2015/0064942 A1 Mar. 5, 2015

(30) Foreign Application Priority Data

Sep. 3, 2013 (JP) ..... 2013-181963

(51) Int. Cl.
*H01R 13/639* (2006.01)
*H01R 12/71* (2011.01)
*H01R 12/70* (2011.01)

(52) U.S. Cl.
CPC ..... *H01R 13/639* (2013.01); *H01R 12/7029* (2013.01); *H01R 12/716* (2013.01)

(58) Field of Classification Search
CPC ..... H01R 13/62933; H01R 13/639
See application file for complete search history.

(56) References Cited

U.S. PATENT DOCUMENTS 4,376,563 A * 3/1983 Margrave et al. .... H01R 13/627 439/358
4,671,594 A * 6/1987 Ohtsuki et al. ..... H01R 13/6395 439/347
5,174,781 A * 12/1992 Muzslay ..... H01R 13/6395 439/370
5,860,827 A * 1/1999 Lee ..... H01R 13/6395 439/372
5,938,468 A * 8/1999 Lin ..... H01R 13/6395 439/372
7,524,205 B1 * 4/2009 Lee ..... H01R 13/6392 439/350
7,867,012 B2 * 1/2011 Won ..... H01R 13/62955 439/372
2004/0248455 A1 * 12/2004 Miller ..... H01R 23/667 439/372
2014/0187059 A1 7/2014 Takemoto

FOREIGN PATENT DOCUMENTS

JP 2005-267977 A 9/2005
JP 2009-170250 A 7/2009
JP 2013-157188 A 8/2013

* cited by examiner

*Primary Examiner* — Gary Paumen
(74) *Attorney, Agent, or Firm* — Studebaker & Brackett PC

(57) ABSTRACT

A circuit-terminal connecting device comprising a first connector having a first housing attached to a first circuit board provided thereon with first circuit-terminals and a first metallic member, a second connector having a second housing attached to a second circuit board provided thereon with second circuit-terminals and a second metallic member and a manipulatable member mounted on the second housing, wherein an end portion of the manipulatable member is formed into a movable locking portion supported by the second metallic member, the first metallic member is provided thereon with a fixed locking portion, and the manipulatable member is resiliently deformed for causing the movable locking portion to engage with the fixed locking portion so that the second housing is put in mechanical lock to the first housing when the second housing is put in engagement with the first housing for connecting the second circuit-terminals with the first circuit-terminals.

10 Claims, 21 Drawing Sheets

CIRCUIT-TERMINAL CONNECTING DEVICE

BACKGROUND OF THE INVENTION

1. Field of the Invention

The present invention relates generally to a circuit-terminal connecting device, and more particularly to an improvement in a circuit-terminal connecting device which comprises first and second electrical connectors fixed respectively to first and second circuit boards including flexible printed circuit boards (FPCs) to be used for putting first and second groups of circuit-terminals provided respectively on the first and second circuit boards in mutual electrical connection under a condition wherein the first and second electrical connectors are coupled with each other so that the second circuit board is closely laid on top of the first circuit board.

2. Description of the Prior Art Including Information Disclosed Under 37 CFR 1.97 and 37 CFR 1.98

Various kinds of electric or electronic parts are built even in a relatively small-sized electronic apparatus such as a mobile phone or the like. A major part of those parts are dispersedly mounted on, for example, a couple of separate circuit boards to fulfill their respective functions. In the relatively small-sized electronic apparatus, having an eye to the couple of separate circuit boards on which the electric or electronic parts are mounted, it is likely that one of the separate circuit boards is required to be closely laid on top of the other of the separate circuit boards for reducing a space occupied thereby when the separate circuit boards are electrically connected with each other. Such electrical connection between the separate circuit boards wherein one is closely laid on top of the other is hereinafter referred to as electrical piled-up connection.

In general, when a plurality of groups of circuit-terminals provided respectively on a plurality of circuit boards are put in mutual electrical connection, a plurality of electrical connectors are respectively fixed to the circuit boards, and one of the electrical connectors is coupled with another of the electrical connectors so as to connect the circuit boards, on which the electrical connectors are respectively fixed, electrically with each other. In case of such an electrical piled-up connection as mentioned above, first and second electrical connectors are respectively fixed on the separate circuit boards to be coupled with each other. For example, the first electrical connector is formed into a receptacle type connector and the second electrical connector is formed into a plug type connector to be a mate electrical connector, so that the plug type connector is engaged with the receptacle type connector when the separate circuit boards are put in a condition of the electrical piled-up connection. The first and second connectors provided to be coupled with each other as described above are required to be maintained stably in a mutual coupling condition.

Under such a situation, there have been previously proposed several circuit-terminal connecting devices, each of which comprises first and second electrical connectors fixed respectively to first and second circuit boards and locking means for locking mechanically the first or second electrical connector to the second or first electrical connector when the first and second electrical connectors are coupled with each other for putting first circuit-terminals provided on the first circuit board and second circuit-terminals provided on the second circuit board in mutual electrical connection, as disclosed in, for example, the Japanese patent application published before examination under publication number 2005-267977 (hereinafter, referred to as published prior art document 1) and the Japanese patent application published before examination under publication number 2009-170250 (hereinafter, referred to as published prior art document 2).

A circuit-terminal connecting device disclosed in the published prior art document 1 comprises a first electrical connector (a plug connector 100) having a first housing (an insulator 11) and a manipulatable member (a pull-bar 10) mounted on the first housing to be rotatable and a second electrical connector (a receptacle connector 102) having a second housing (an insulator 21). The manipulatable member mounted on the first housing is made of metallic bar material to have an arm portion (10*b*) at each of both ends thereof and a rotating axis (10*a*) to form a top end of the arm portion. The rotating axis extends to pass through an outside wall portion of the first housing from the outside to the inside of the same so as to constitute a locking portion (a part of a locking mechanism) to the second electrical connector. A rib (7) is provided on an external surface of the outside wall portion of the first housing to project outwardly and a protrusion (1) is provided on an external surface of an inside wall portion of the second housing.

When the first and second electrical connectors are coupled with each other, the outside wall portion of the first housing of the first electrical connector is placed at the outside of the inside wall portion of the second housing of the second electrical connector so that the first housing is engaged with the second housing. On that occasion, the rotating axis of the manipulatable member provided on the first housing of the first electrical connector engages with the protrusion provided on the external surface of the inside wall portion of the second housing of the second electrical connector to put the first housing in mechanical lock to the second housing so that first and second electrical connectors are maintained in the mutual coupling condition.

After that, when the manipulatable member provided on the first housing of the first electrical connector is rotated, the arm portion of the manipulatable member is moved to get on the rib provided on the external surface of the outside wall portion of the first housing so that the manipulatable member is resiliently deformed to shift the rotating axis of the manipulatable member to the outside of the inside wall portion of the second housing of the second electrical connector and thereby the rotating axis of the manipulatable member disengages from the protrusion provided on the external surface of the inside wall portion of the second housing. Consequently, the first housing is released from the mechanical lock to the second housing by the locking portion including the rotating axis of the manipulatable member. After the rotating axis of the manipulatable member has disengaged from the protrusion provided on the external surface of the inside wall portion of the second housing, the manipulatable member is further rotated to be resiliently restored to the original state.

Then, a circuit-terminal connecting device disclosed in the published prior art document 2 comprises a first electrical connector (a receptacle connector 200) having a first housing (an insulator 202) and a metallic member (a shell 250) covering a major part of the first housing and a second electrical connector (a plug connector 300) having a second housing (an insulator 340) and a manipulatable member (a pull-bar 370) mounted on the second housing to be rotatable. The metallic member of the first electrical connector has a locking portion (252) on which an engaging hole (254) is formed. The manipulatable member mounted on the second housing is made of metallic bar material to have a main portion (372), a connecting portion (376) extending to be bent in a direction crossing the main portion from each of end portions of the main portion opposite to each other, and an engaging portion (374) extending to be bent further in a direction along the main portion from each of the connecting portions. The second housing of the second electrical connector has an outside wall portion, on an internal surface of which a cam portion (348) is provided. The engaging portion of the manipulatable member extends to pass through the outside wall portion of the second housing from the inside to the outside of the same so that a top end of the engaging portion projects to the outside of the outside wall portion of the second housing to constitute a locking end portion (375) to the first housing of the first electrical connector.

When the first and second electrical connectors are coupled with each other, the outside wall portion of the second housing of the second electrical connector is placed at the inside of the locking portion of the metallic member of the first electrical connector, on which the engaging hole is formed, so that the second housing is engaged with the first housing. On that occasion, the locking end portion at the top end of the engaging portion of the manipulatable member provided on the second housing of the second electrical connector engages with the engaging hole formed on the locking portion of the metallic member of the first electrical connector to put the second housing in mechanical lock to the first housing so that first and second electrical connectors are maintained in the mutual coupling condition.

After that, when the manipulatable member provided on the second housing of the second electrical connector is rotated, the connecting portion of the manipulatable member is moved under guidance with the cam provided on the internal surface of the outside wall portion of the second housing so that the manipulatable member is resiliently deformed to shift the locking portion at the top end of the engaging portion extending to be bent from the connecting portion of the manipulatable member to the inside of the outside wall portion of the second housing and thereby the locking end portion at the top end of the engaging portion of the manipulatable member disengages from the engaging hole formed on the locking portion of the metallic member of the first electrical connector. Consequently, the second housing is released from the mechanical lock to the first housing by the locking end portion at the top end of the engaging portion of the manipulatable member. After the locking end portion of the manipulatable member has disengaged from the engaging hole formed on the locking portion of the metallic member of the first electrical connector, the manipulatable member is further rotated to be resiliently restored to the original state.

In the previously proposed circuit-terminal connecting devices, each of which comprises first and second electrical connectors fixed respectively to first and second circuit boards and locking means for locking mechanically the first or second electrical connector to the second or first electrical connector when the first and second electrical connectors are coupled with each other for putting first circuit-terminals provided on the first circuit board and second circuit-terminals provided on the second circuit board in mutual electrical connection, as described above, there are the following defects or disadvantages.

In the case of the circuit-terminal connecting device disclosed in the published prior art document 1, the rotating axis of the manipulatable member made of metallic bar material to be provided on the first housing of the first electrical connector engages with the protrusion provided on the second housing of the second electrical connector to put the first housing in mechanical lock to the second housing under a condition wherein the manipulatable member is not resiliently deformed when the first and second electrical connectors are coupled with each other and then the rotating axis of the manipulatable member disengages from the protrusion provided on the second housing to release the first housing from the mechanical lock to the second housing under a condition wherein the manipulatable member is resiliently deformed. Accordingly, under a condition wherein a locked state in which the first housing is put in the mechanical lock to the second housing and an unlocked state in which the first housing is released from the mechanical lock to the second housing are taken repeatedly, the rotating axis of the manipulatable member engages with the protrusion provided on the second housing to put the first housing in the mechanical lock to the second housing under a condition wherein the manipulatable member is caused to restore not to be resiliently deformed after being once deformed resiliently.

Therefore, it is feared that the arm portion of the manipulatable member is undesirably subjected to plastic deformation so as not to restore appropriately to the original state when the manipulatable member is caused to restore not to be resiliently deformed after being once deformed resiliently. In the case where such a plastic deformation as mentioned above is brought on the arm portion of the manipulatable member, the rotating axis of the manipulatable member is shifted in its position by the plastic deformation of the arm portion of the manipulatable member so as not to engage appropriately with the protrusion provided on the second housing and thereby the first housing is put in unsure or unstable mechanical lock to the second housing.

Further, in the circuit-terminal connecting device disclosed in the published prior art document 1, the rotating axis of the manipulatable member is supported by the outside wall portion of the first housing after having passed through the same from the outside to the inside thereof to engage with the protrusion provided on the second housing. That is, the rotating axis of the manipulatable member is not supported by any metallic member having relatively large stiffness but supported by the first housing made of insulating material inferior in stiffness for locking the first housing to the second housing. Therefore, especially under a situation wherein a thickness of each of the first and second housings is reduces for miniaturization and reduction in weight of the first and second electrical connectors, it is feared that the rotating axis of the manipulatable member is unsurely or unstably supported by the outside wall portion of the first housing so as not to engage surely and reliably with the protrusion provided on the second housing.

Then, in the case of the circuit-terminal connecting device disclosed in the published prior art document 2, the locking end portion at the top end of the engaging portion of the manipulatable member made of metallic bar material to be provided on the second housing of the second electrical connector engages with the engaging hole formed on the locking portion of the metallic member of the first electrical connector to put the second housing in mechanical lock to the first housing under a condition wherein the manipulatable member is not resiliently deformed when the first and second electrical connectors are coupled with each other and then the locking end portion of the manipulatable member disengages from the engaging hole formed on the locking portion of the metallic member of the first electrical connector to release the second housing from the mechanical lock to the first housing under a condition wherein the manipulatable member is resiliently deformed. Accordingly, under a condition wherein a locked state in which the second housing is put in the mechanical lock to the first housing and an unlocked state in which the second housing is released from the mechanical lock to the first housing are taken repeatedly, the locking end portion of the manipulatable member engages with the engaging hole formed on the locking portion of the metallic member of the first electrical connector to put the second housing in the mechanical lock to the first housing under a condition wherein the manipulatable member is caused to restore not to be resiliently deformed after being once deformed resiliently.

Therefore, it is feared that the engaging portion of the manipulatable member is undesirably subjected to plastic deformation so as not to restore appropriately to the original state when the manipulatable member is caused to restore not to be resiliently deformed after being once deformed resiliently. In the case where such a plastic deformation as mentioned above is brought on the engaging portion of the manipulatable member, the locking end portion of the manipulatable member is shifted in its position by the plastic deformation of the engaging portion of the manipulatable member so as not to engage appropriately with the engaging hole formed on the locking portion of the metallic member of the first electrical connector and thereby the second housing is put in unsure or unstable mechanical lock to the first housing.

Further, in the circuit-terminal connecting device disclosed in the published prior art document 2, the engaging portion of the manipulatable member is supported by the outside wall portion of the second housing, on the internal surface of which the cam portion is provided, after having passed through the same from the inside to the outside thereof so as to cause the locking end portion at the top end of the engaging portion to engage with the engaging hole formed on the locking portion of the metallic member of the first electrical connector. That is, the engaging portion of the manipulatable member having the locking end portion at its top end is not supported by any metallic member having relatively large stiffness but supported by the second housing made of insulating material inferior in stiffness for locking the second housing to the first housing. Therefore, especially under a situation wherein a thickness of each of the first and second housings is reduces for miniaturization and reduction in weight of the first and second electrical connectors, it is feared that the engaging portion of the manipulatable member is unsurely or unstably supported by the outside wall portion of the second housing so that the locking end portion at the top end of the engaging portion is not able to engage surely and reliably with the engaging hole formed on the locking portion of the metallic member of the first electrical connector.

BRIEF SUMMARY OF THE INVENTION

Accordingly, it is an object of the present invention to provide a circuit-terminal connecting device for connecting electrically first circuit-terminals provided on a first circuit board with second circuit-terminals provided on a second circuit board, which comprises a first electrical connector having a first housing attached to the first circuit board and a second electrical connector having a second housing attached to the second circuit board which are operative to be coupled with each other for putting the first and second circuit boards in electrical piled-up connection wherein the first and second circuit-terminals are electrically connected with each other through the first and second electrical connectors, and which avoids the aforementioned problems and disadvantages encountered with the prior art.

Another object of the present invention is to provide a circuit-terminal connecting device for connecting electrically first circuit-terminals provided on a first circuit board with second circuit-terminals provided on a second circuit board, which comprises a first electrical connector having a first housing attached to the first circuit board and a second electrical connector having a second housing attached to the second circuit board which are operative to be coupled with each other for putting the first and second circuit boards in electrical piled-up connection wherein the first and second circuit-terminals are electrically connected with each other through the first and second electrical connectors, and in which a locking means is provided on one of the first and second electrical connectors to be shiftable in its position and one of the first and second housings can be mechanically locked surely, stable and reliably to the other of the first and second housing by the locking means.

A further object of the present invention is to provide a circuit-terminal connecting device for connecting electrically first circuit-terminals provided on a first circuit board with second circuit-terminals provided on a second circuit board, which comprises a first electrical connector having a first housing attached to the first circuit board and a second electrical connector having a second housing attached to the second circuit board which are operative to be coupled with each other for putting the first and second circuit boards in electrical piled-up connection wherein the first and second circuit-terminals are electrically connected with each other through the first and second electrical connectors, and in which one of the first and second housings can be surely released from mechanical lock to the other of the first and second housings by means of simple and easy manipulation without using any specified tool or the like.

According to the present invention, there is provided a circuit-terminal connecting device for connecting electrically first circuit-terminals provided on a first circuit board with second circuit-terminals provided on a second circuit board, which comprises a first electrical connector having a first housing attached to the first circuit board, a plurality of first contacts arranged on the first housing to be connected with the first circuit-terminals, and a first metallic member fixed to the first housing; a second electrical connector having a second housing attached to the second circuit board and operative to engage with the first housing, a plurality of second contacts arranged on the second housing to be connected with the second circuit-terminals for coming into press-contact with the first contacts when the second housing is put in engagement with the first housing, so that the second circuit-terminals are electrically connected with the first circuit-terminals through the first and second electrical connectors, and a second metallic member attached to the second housing; and a manipulatable member shaped into a bent rod and mounted on the second housing to be shiftable in its position for taking up selectively a first station in which the manipulatable member keeps lying down on the second housing and a second station in which the manipulatable member keeps rising from the second housing, wherein each of end portions of the manipulatable member opposite to each other is formed into a movable locking portion operative to pass through the second metallic member to be supported by the second metallic member; the first metallic member is provided thereon with a pair of fixed locking portions; the manipulatable member is shifted under guidance with a cam portion provided in the second electrical connector to be resiliently deformed for causing the movable locking portions to engage respectively with the fixed locking portions so that the second housing is put in mechanical lock to the first housing when the second housing is put in engagement with the first housing and the manipulatable member takes up the first station; and the manipulatable member is resiliently restored from a state of deformation by means of the cam portion to an original state for causing the movable locking portions to disengage respectively from the fixed locking portions so that the second housing is released from the mechanical lock to the first housing when the second housing is put in the engagement with the first housing and the manipulatable member takes up the second station.

In an embodiment of circuit-terminal connecting device according to the present invention, the cam portion provided in the second electrical connector is configured as a part of the second metallic member. Further, in the embodiment, under a condition wherein the second housing is put in engagement with the first housing, each of the movable locking portions supported by the second metallic member moves in one of first and second directions opposite to each other to engage with the fixed locking portion when the manipulatable member is shifted from the second station to the first station and then moves in the other of the first and second directions to disengage from the fixed locking portion when the manipulatable member is shifted from the first station to the second station.

In the circuit-terminal connecting device thus constituted in accordance with the present invention, when the second housing of the second electrical connector is put in engagement with the first housing of the first electrical connector, the second contacts in the second electrical connector come into press-contact respectively with the first contacts in the first electrical connector. Further, each of the end portions of the manipulatable member opposite to each other is formed into the movable locking portion operative to pass through the second metallic member of the second electrical connector to be supported by the second metallic member and the first metallic member of the first electrical connector is provided thereon with the fixed locking portions.

Under the condition wherein the second housing is put in the engagement with the first housing, the manipulatable member is shifted under guidance with the cam portion provided in the second electrical connector to be resiliently deformed for causing the movable locking portions to engage respectively with the fixed locking portions so that the second housing is put in the mechanical lock to the first housing when the manipulatable member takes up the first station. Then, under a condition wherein the second housing is put in the mechanical lock to the first housing, the manipulatable member is resiliently restored from the state of the deformation by means of the cam portion to the original state for causing the movable locking portions to disengage respectively from the fixed locking portions so that the second housing is released from the mechanical lock to the first housing when the manipulatable member takes up the second station.

That is, when each of the movable locking portions at the ends of the manipulatable member engages with the fixed locking portion provided on the first metallic member of the first electrical connector so that the second housing is put in the mechanical lock to the first housing, the manipulatable member is shifted under guidance with the cam portion provided in the second electrical connector to be resiliently deformed. Then, when each of the movable locking portion at the ends of the manipulatable member disengages from the fixed locking portion provided on the first metallic member of the first electrical connector so that the second housing is released from the mechanical lock to the first housing, the manipulatable member is resiliently restored from the state of the deformation by means of the cam portion to the original state.

The cam portion provided in the second electrical connector is, for example, configured as a portion of the second metallic member of the second electrical connector.

Further, under the condition wherein the second housing is put in engagement with the first housing, for example, each of the movable locking portions supported by the second metallic member of the second electrical connector moves in the first direction to engage with the fixed locking portion when the manipulatable member is shifted from the second station to the first station and then moves in the second direction opposite to the first direction to disengage from the fixed locking portion when the manipulatable member is shifted from the first station to the second station.

With the circuit-terminal connecting device according to the present invention, when each of the movable locking portions at the ends of the manipulatable member engages with the fixed locking portion provided on the first metallic member of the first electrical connector so that the second housing is put in the mechanical lock to the first housing, the manipulatable member is resiliently deformed by means of the cam portion provided in the second electrical connector, and when each of the movable locking portions at the ends of the manipulatable member disengages from the fixed locking portion provided on the first metallic member of the first electrical connector so that the second housing is released from the mechanical lock to the first housing, the manipulatable member is resiliently restored from the state of the deformation by means of the cam portion to the original state. That is, when the second housing is locked to the first housing, the manipulatable member having the movable locking portions at its ends is resiliently deformed to force the movable locking portions to engage respectively with the fixed locking portions. Accordingly, even if a locked state in which the second housing is put in the mechanical lock to the first housing and an unlocked state in which the second housing is released from the mechanical lock to the first housing are taken repeatedly, the movable locking portion at each of the ends of the manipulatable member is able to engage properly and surely with the fixed locking portion provided on the first metallic member of the first electrical connector so that the second housing is mechanically locked surely and reliably to the first housing.

Further, in the circuit-terminal connecting device according to the present invention, each of the movable locking portions at the ends of the manipulatable member is operative to pass through the second metallic member of the second electrical connector to be supported by the second metallic member and the first metallic member of the first electrical connector is provided thereon with the fixed locking portion, so that each of the movable locking portions at the ends of the manipulatable member is supported by the second metallic member having relatively large stiffness to engage with the fixed locking portion provided on the first metallic member also having relatively large stiffness. Accordingly, even if a thickness of each of the first and second housings is reduces for miniaturization and reduction in weight of the first and second electrical connectors, each of the movable locking portions at the ends of the manipulatable member is able to be put in firm engagement with the fixed locking portion provided on the first metallic member so that the second housing is mechanically locked stably and reliably to the first housing.

Besides, with the circuit-terminal connecting device according to the present invention, for causing the movable locking portions at the ends of the manipulatable member to disengage respectively with the fixed locking portions provided on the first metallic member so that the second housing is released from the mechanical lock to the first housing, it is required only to shift the manipulatable member from the first station in which the manipulatable member keeps lying down on the second housing to the second station in which the manipulatable member keeps rising from the second housing. Accordingly, the second housing can be surely released from the mechanical lock to the first housing by means of simple and easy manipulation without using any specified tool or the like.

The above, and other objects, features and advantages of the present invention will become apparent from the following detailed description taken in conjunction with the accompanying drawings.

DETAILED DESCRIPTION OF THE INVENTION

Figure 1:
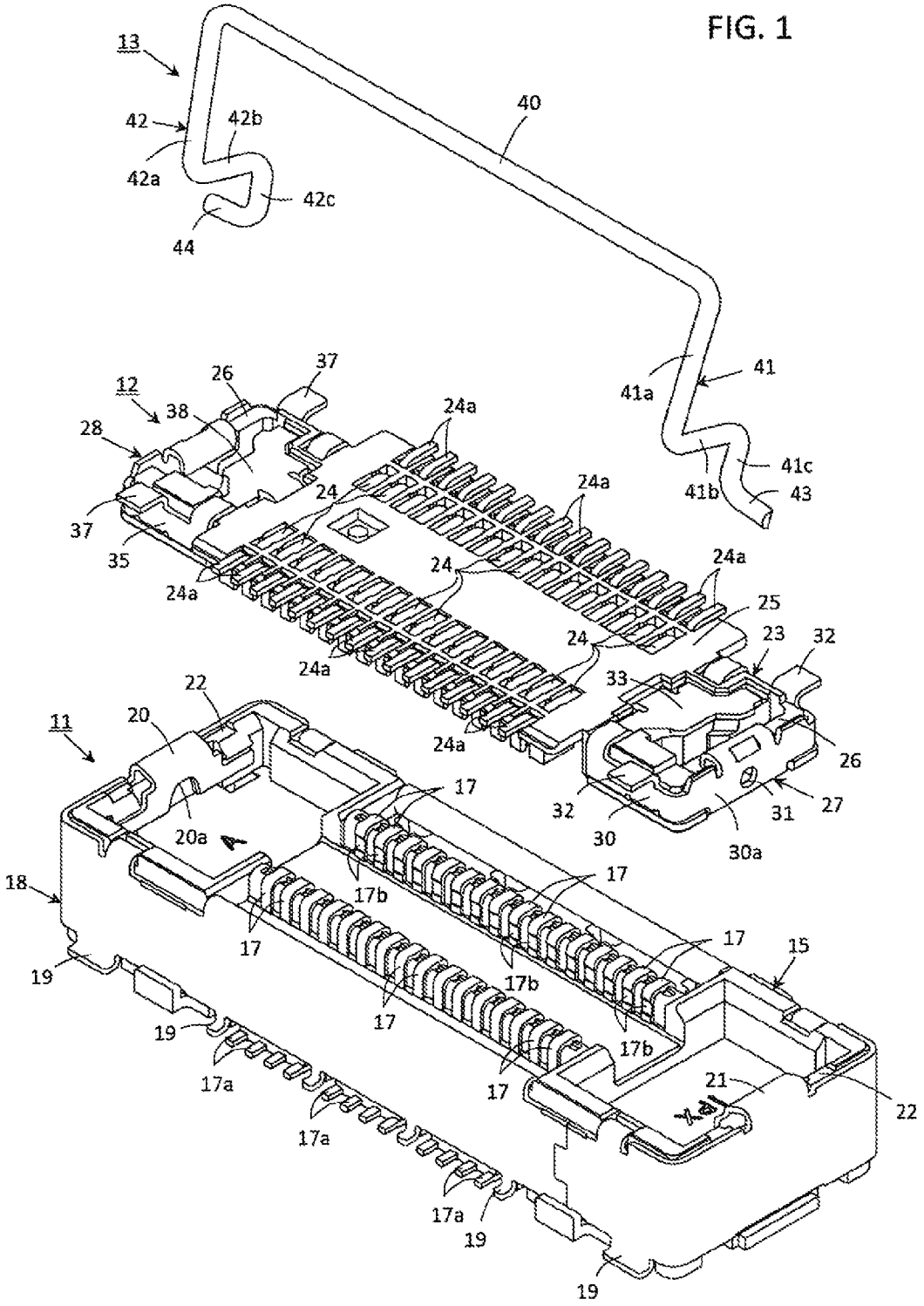
FIG. 1 is a schematic perspective view showing a receptacle type connector, a plug type connector and a manipulatable member separated from one another, each of which are included in an embodiment of circuit-terminal connecting device according to the present invention.

FIG. 1 shows a receptacle type connector 11 constituting a first electrical connector, a plug type connector 12 constituting a second electrical connector and a manipulatable member 13 each included in an embodiment of circuit-terminal connecting device according to the present invention which comprises the first electrical connector, the second electrical connector and the manipulatable member 13.

The receptacle type connector 11 shown in FIG. 1 has a housing 15 made of insulator such as plastics or the like to constitute a first housing. The housing 15 is mounted on a surface of a first circuit board 16, which is imaginarily shown with chain lines in FIG. 7 mentioned later, to be attached to the first circuit board 16 when the receptacle type connector 11 is put to practical use. The surface of the first circuit board 16 on which the housing 15 is mounted faces upward in FIG. 7 (hereinafter, referred to an upper surface of the first circuit board 16).

Figure 23:
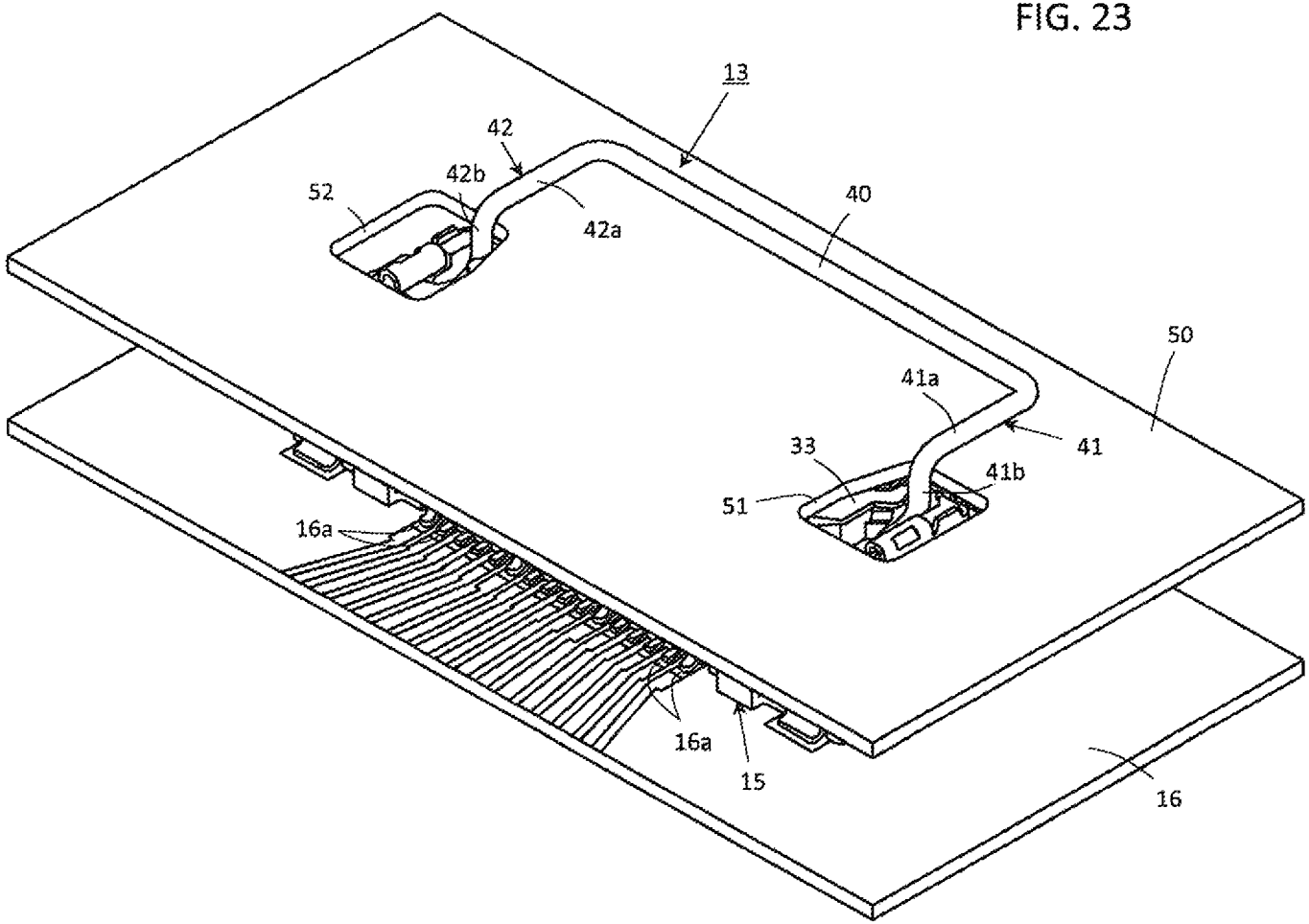
FIG. 23 is a schematic perspective view showing a first circuit board to which a housing of the receptacle type connector shown in FIG. 1 is attached, the a second circuit board to which a housing of the plug type connector shown in FIG. 1 and coupled with the receptacle type connector is attached, and the manipulatable member shown in FIG. 1 and taking up the first station.

A plurality of first contacts 17 are arranged on the housing 15 to make a couple of parallel lines each elongating along a longitudinal direction of the housing 15. Each of the first contacts 17 is made of resilient conductive plate material to be shaped into a bent stripe and provided, respectively at both end portions of the bent stripe, with a board connecting portion 17*a* operative to be connected with one of circuit terminals 16*a*, which is shown in FIG. 23 mentioned later, provided on the upper surface of the first circuit board 16 and a contact-connecting portion 17*b* operative to come into contact with one of second contacts provided in the plug type connector 12 as explained later.

Figure 2:
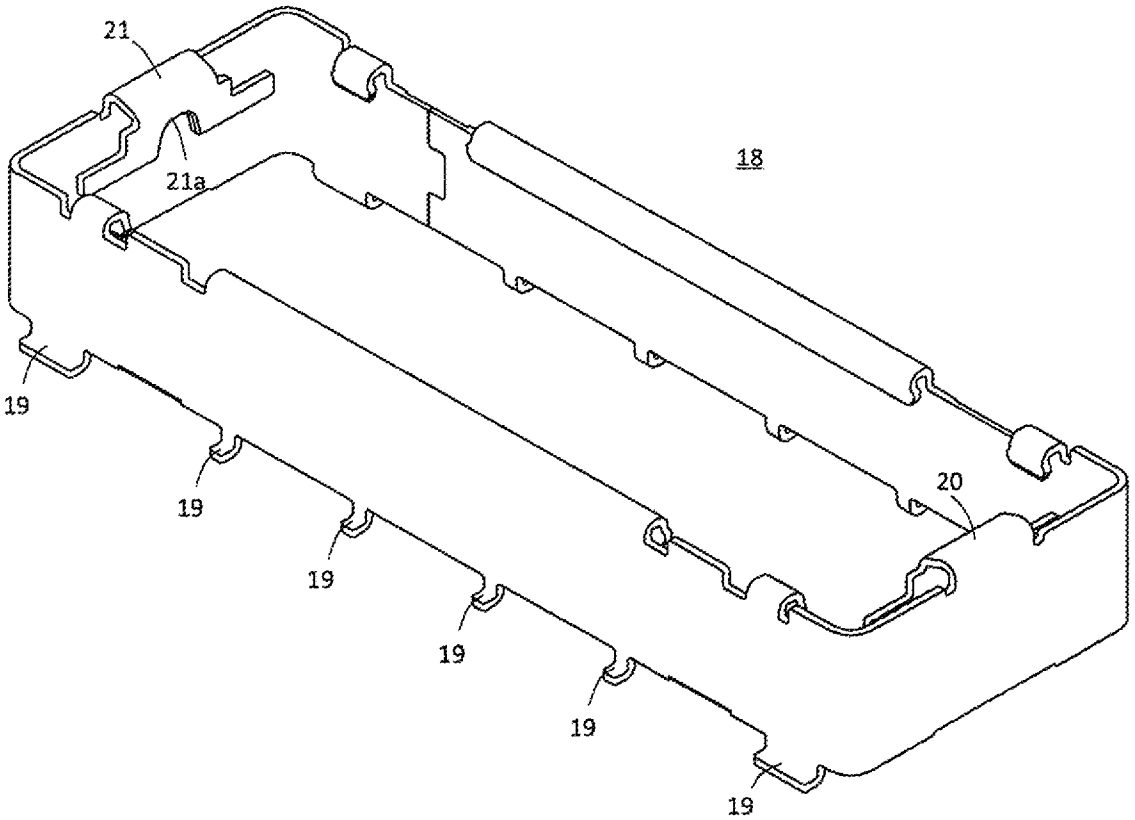
FIG. 2 is a schematic perspective view showing a first metallic member to be contained in the receptacle type connector shown in FIG. 1.

Further, a first metallic member 18 is attached to the housing 15 for surrounding an exterior round surface of the housing 15 along the upper surface of the first circuit board 16. As shown in FIG. 2, the first metallic member 18 is shaped into a rectangular enclosure having lower and upper annular edge portions opposite to each other. A plurality of board joining portions 19 are provided on the lower annular edge portion of the first metallic member 18 to be joined to the upper surface of the first circuit board 16 and a pair of fixed locking portions 20 and 21 are provided on the upper annular edge portion of the first metallic member 18.

When the board joining portions 19 are joined to the upper surface of the first circuit board 16, the first metallic member 18 is attached to the first circuit board 16 along with the housing 15 so as to contribute to attach the housing 15 to the first circuit board 16. The fixed locking portions 20 and 21 are positioned to correspond respectively to both end portions 22 of the housing 15 in a direction along which the first contacts 17 are arranged (hereinafter, referred to as a first contact-arrangement direction). A notch 20*a* is formed on the fixed locking portion 20 as shown in FIG. 1 and a notch 21*a* is also formed on the fixed locking portion 21. Each of the fixed locking portions 20 and 21 is provided for receiving a movable locking portion formed on the manipulatable member 13, which is operative to engage with the fixed locking portion 20 or the fixed locking portion 21 as explained later.

The fixed locking portions 20 and 21 thus provided on the first metallic member 18 are opposite to each other in a direction along the upper surface of the first circuit board 16 and the first contact-arrangement direction.

The plug type connector 12 shown in FIG. 1 has a housing 23 made of insulator such as plastics or the like to constitute a second housing. The housing 23 is mounted on a surface of a second circuit board 29, which is shown with chain lines in FIG. 7 mentioned later, to be attached to the second circuit board 29 when the plug type connector 12 is put to practical use. The surface of the second circuit board 29 on which the housing 23 is mounted faces downward in FIG. 7 (hereinafter, referred to a lower surface of the first circuit board 16).

A plurality of second contacts 24 are arranged on the housing 23 to make a couple of parallel lines each elongating along a longitudinal direction of the housing 23. Each of the second contacts 24 is made of resilient conductive plate material to be shaped into a bent stripe and provided, respectively at both end portions of the bent stripe, with a board connecting portion 24*a* operative to be connected with one of circuit terminals provided on the lower surface of the second circuit board 29 and a contact-connecting portion operative to come into contact with the contact-connecting portion 17*b* of the first contact 17 provided in the receptacle type connector 11.

The housing 23 constituting the second housing has a flat board portion 25 for coming close to the lower surface of the second circuit board 29. The board connecting portion 24*a* of the second contacts 24 are arranged on an exterior surface of the flat board portion 25 of the housing 23.

Further, a pair of second metallic members 27 and 28 are attached respectively to a pair of end portions 26 of the housing 23 to be opposite to each other in a direction along which the second contacts 24 are arranged (hereinafter, referred to as a second contact-arrangement direction).

Figure 3:
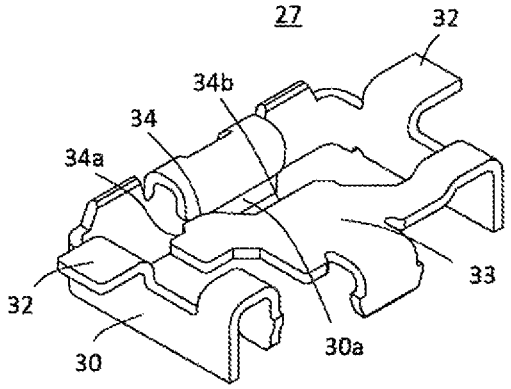
FIG. 3 is a schematic perspective view showing one of a pair of second metallic members to be contained in the plug type connector shown in FIG. 1.

As shown in FIG. 3, the second metallic member 27 has a ⊐-shaped body 30 for covering an exterior surface of one of the end portions 26 of the housing 23. An opening 31 which is shown in FIG. 1 is formed on a central portion 30*a* of the ⊐-shaped body 30, a board connecting portion 32 is provided on each of side wall portions extending respectively from both ends of the central portion 30*a* of the ⊐-shaped body 30 to be opposite to each other, and a cam portion 33 is provided on a free end of one of the side wall portions of the central portion 30*a* to extend therefrom for constituting a part of the second metallic member 27. The cam portion 33 has a cam face 34 including a first end face 34*a* and a second end face 34*b*. The opening 31 formed on the central portion 30*a* of the ⊐-shaped body 30 is operative to receive the movable locking portion provided on the manipulatable member 13 explained later, which is operative to engage with the opening 31, and the cam face 34 of the cam portion 33 is operative to guide the manipulatable member 13 when the manipulatable member 13 is shifted in its position.

Figure 4:
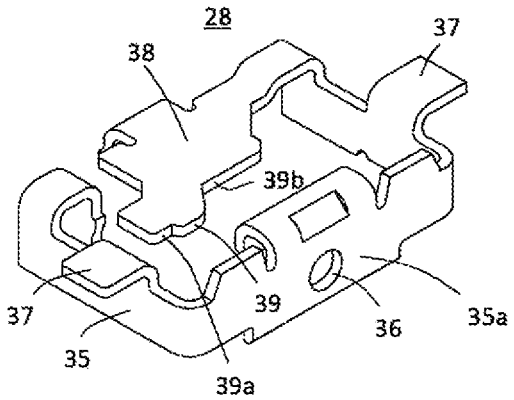
FIG. 4 is a schematic perspective view showing the other of the second metallic members to be contained in the plug type connector shown in FIG. 1.

Further, as shown in FIG. 4, the second metallic member 28 has a ⊐-shaped body 35 for covering an exterior surface of the other of the end portions 26 of the housing 23. An opening 36 is formed on a central portion 35*a* of the ⊐-shaped body 35, a board connecting portion 37 is provided on each of side wall portions extending respectively from both ends of the central portion 35*a* of the ⊐-shaped body 35 to be opposite to each other, and a cam portion 38 is provided on a free end of one of the side wall portions of the central portion 35*a* to extend therefrom for constituting a part of the second metallic member 28. The cam portion 38 has a cam face 39 including a first end face 39*a* and a second end face 39*b*. The opening 36 formed on the central portion 35*a* of the ⊐-shaped body 35 is operative to receive the movable locking portion provided on the manipulatable member 13 explained later, which is operative to engage with the opening 36, and the cam face 39 of the cam portion 38 is operative to guide the manipulatable member 13 when the manipulatable member 13 is shifted in its position.

The second metallic member 27 attached to the end portion 26 of the housing 23 is attached to the lower surface of the second circuit board 29 along with the housing 23 when the board connecting portions 32 of the second metallic member 27 are connected with the lower surface of the second circuit board 29 and the second metallic member 28 attached to the end portion 26 of the housing 23 is attached to the lower surface of the second circuit board 29 along with the housing 23 when the board connecting portions 37 of the second metallic member 28 are connected with the lower surface of the second circuit board 29. Therefore, each of the second metallic members 27 and 28 is operative to contribute to attach the housing 23 to the second circuit board 29.

The manipulatable member 13 shown in FIG. 1 is formed by bending a resilient metallic rod or the like to be mounted on the housing 23 of the plug type connector 12. The manipulatable member 13 mounted on the housing 23 is shiftable in its position for taking up selectively a first station in which the manipulatable member 13 keeps lying down on the housing 23 and a second station in which the manipulatable member 13 keeps rising from the housing 23. Further, the manipulatable member 13 mounted on the housing 23 has a middle portion 40 extending linearly in the second contact-arrangement direction, a pair of connecting portions 41 and 42 extending to be bent respectively from both ends of the middle portion 40, an end portion 43 extending from the connecting portion 41 and an end portion 44 extending from the connecting portion 42, The connecting portion 41 of the manipulatable member 13 includes a first connecting part 41*a*, a second connecting part 41*b* and a third connecting part 41*c* and extends to be bent for connecting one of the ends of the middle portion 40 of the manipulatable member 13 with the end portion 43 of the manipulatable member 13. Similarly, the connecting portion 42 of the manipulatable member 13 includes a first connecting part 42*a*, a second connecting part 42*b* and a third connecting part 42*c* and extends to be bent for connecting the other of the ends of the middle portion 40 of the manipulatable member 13 with the end portion 44 of the manipulatable member 13.

The end portion 43 of the manipulatable member 13 constitutes a first movable locking portion which engages with the opening 31 formed on the central portion 30*a* of the ⊐-shaped body 30 of the second metallic member 27 in the plug type connector 12 for passing through the second metallic member 27 to be supported by the same. Hereinafter, the end portion 43 of the manipulatable member 13 is referred to as a movable locking portion 43. Similarly, the end portion 44 of the manipulatable member 13 constitutes a second movable locking portion which engages with the opening 36 formed on the central portion of the ⊐-shaped body 35 of the second metallic member 28 in the plug type connector 12 for passing through the second metallic member 28 to be supported by the same. Hereinafter, the end portion 44 of the manipulatable member 13 is referred to as a movable locking portion 44.

The manipulatable member 13 thus constituted is mounted on the housing 23 of the plug type connector 12 to be shiftable in its position with the movable locking portion 43 passing through the second metallic member 27 to be supported by the same and the movable locking portion 44 passing through the second metallic member 28 to be supported by the same.

Under such a condition, when the lower surface of the second circuit board 29 to which the housing 23 of the plug type connector 12 is attached along with the manipulatable member 13 mounted on the housing 23 to be shiftable in its position is caused to face to the upper surface of the first circuit board 16 to which the housing 15 of the receptacle type connector 11 is attached and then the second circuit board 29 is closely laid on top of the first circuit board 16, the receptacle type connector 11 and the plug type connector 12 constituting respectively the first and second connectors included in the embodiment of circuit board connecting device according to the present invention are put in mutual coupling wherein the housing 23 of the plug type connector 12 engages with the housing 15 of the receptacle type connector 11, as shown in FIGS. 5 to 7 and 13 to 15. In FIGS. 5, 6, 13 and 14, the first and second circuit boards 16 and 29 are omitted to be disappear as a matter of convenience, and in FIGS. 7 and 15, the first and second circuit boards 16 and 29 are imaginarily shown with chain lines as a matter of convenience.

When the receptacle type connector 11 and the plug type connector 12 are put in the mutual coupling, the contact-connecting portion of each of the second contact 24 arranged on the housing 23 of the plug type connector 12 is caused to come into contact with the contact-connecting portion 17*b* of a corresponding one of the first contacts 17 arranged on the housing 15 of the receptacle type connector 11. Thereby, the second contacts 24 are electrically connected respectively with the first contacts 17, so that each of the circuit terminals provided on the lower surface of the second circuit board 29, with which the board connecting portion 24*a* of the second contact 24 is connected, is electrically connected through the second contact 24 and the first contact 17 with a corresponding one of the circuit terminals provided on the upper surface of the first circuit board 16, with which the board connecting portion 17*a* of the first contact 17 is connected.

Figure 5:
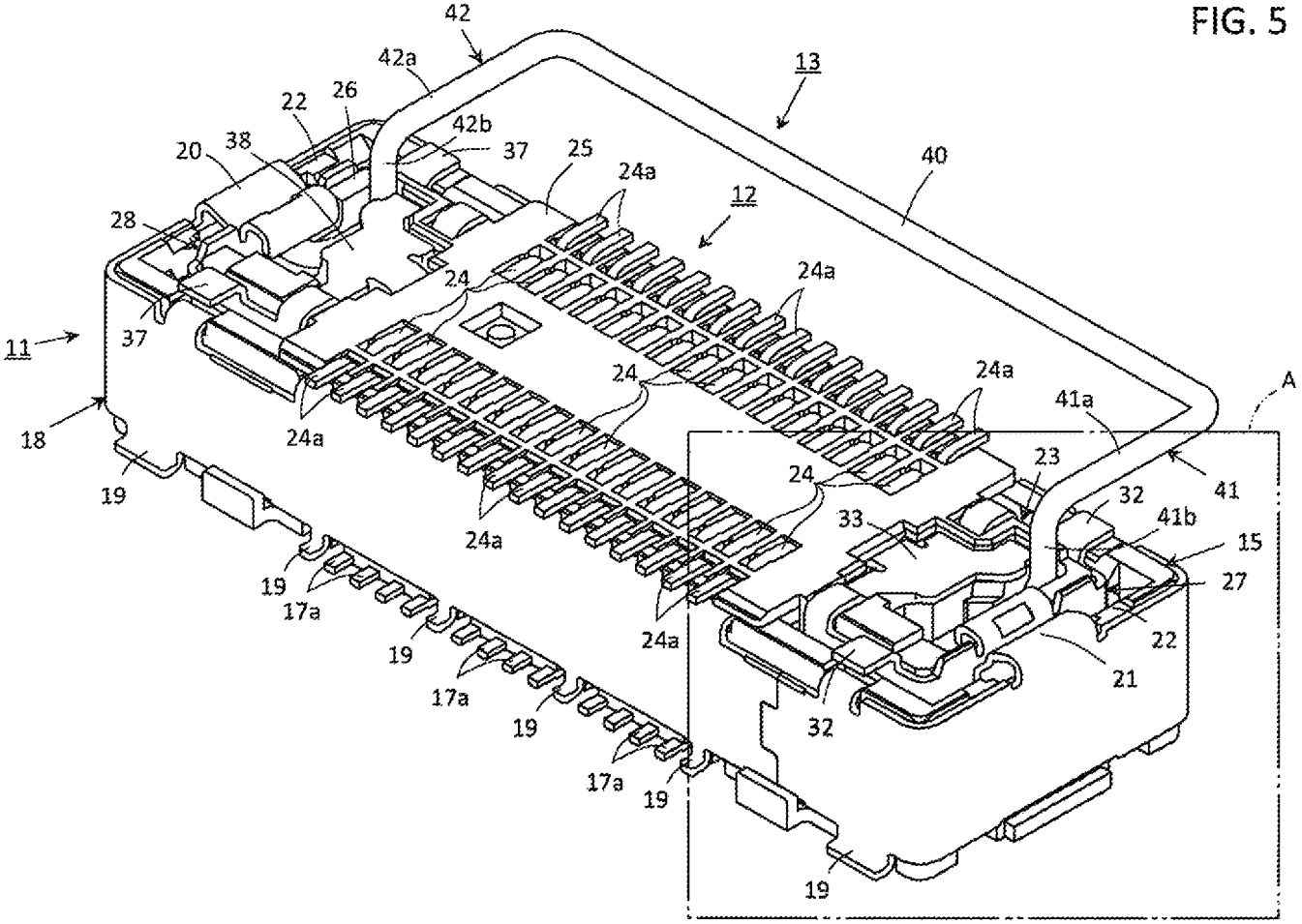
FIG. 5 is a schematic perspective view showing the embodiment of circuit-terminal connecting device according to the present invention, in which the receptacle type connector and the plug type connector are coupled with each other and the manipulatable member takes up a first station.
Figure 6:
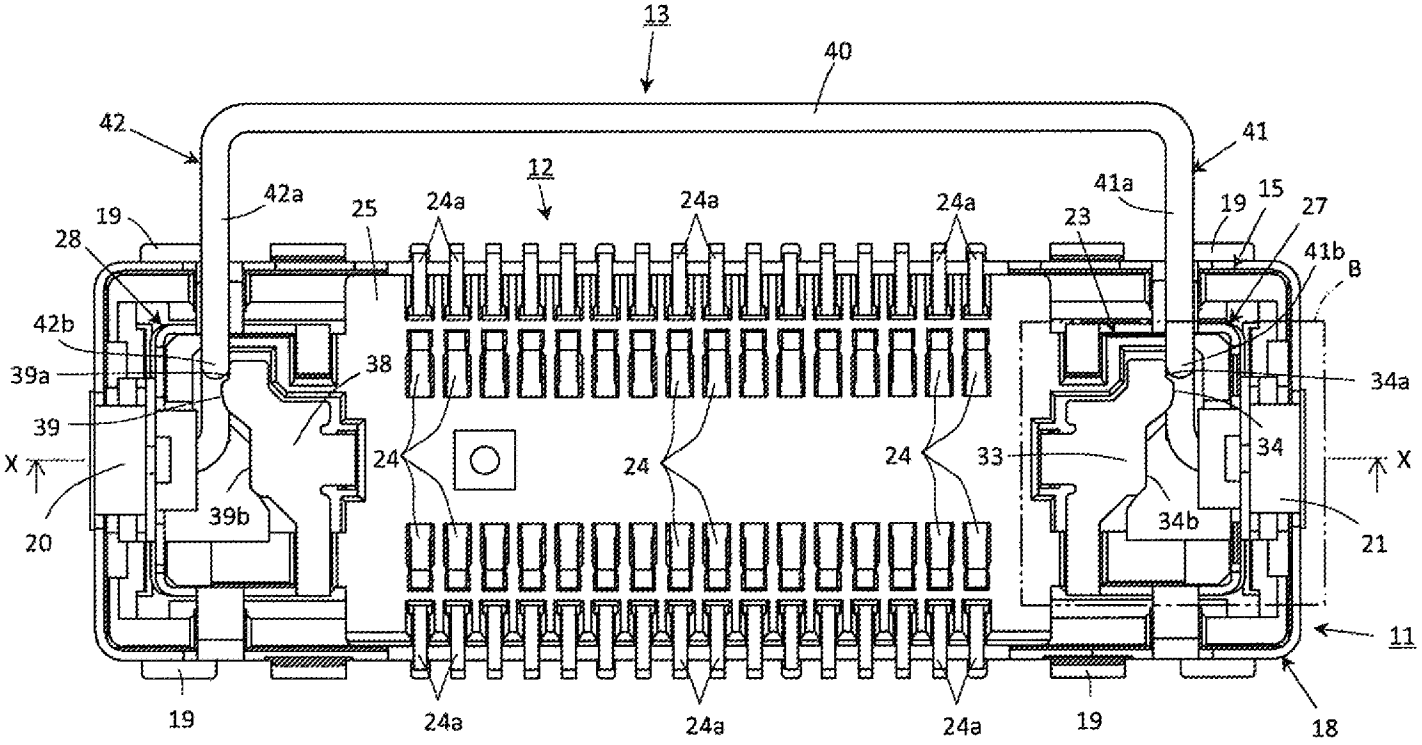
FIG. 6 is a schematic plan view showing the embodiment of circuit-terminal connecting device according to the present invention, in which the receptacle type connector and the plug type connector are coupled with each other and the manipulatable member takes up the first station.
Figure 7:
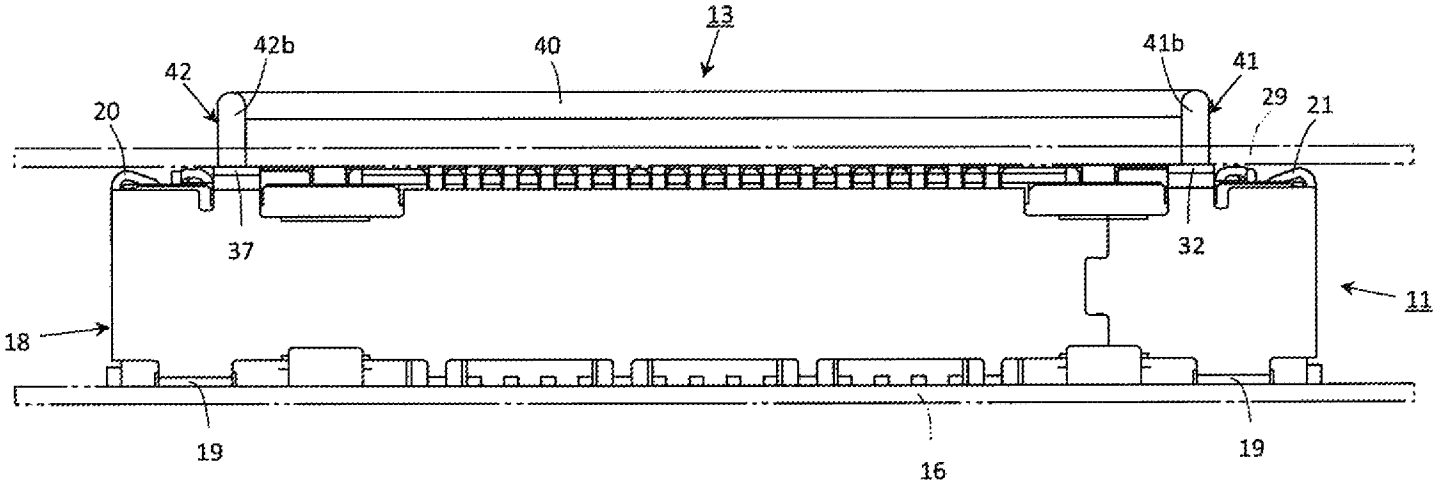
FIG. 7 is a schematic side view showing the embodiment of circuit-terminal connecting device according to the present invention, in which the receptacle type connector and the plug type connector are coupled with each other and the manipulatable member takes up the first station.
Figure 8:
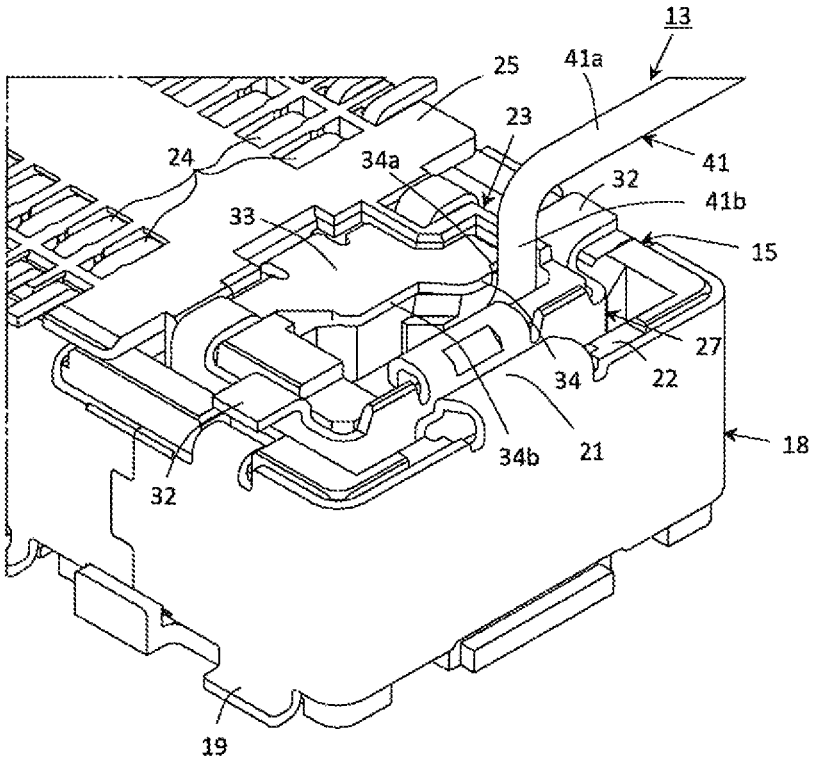
FIG. 8 is a schematic enlarged partial perspective view showing an inside of a tow-dot chain line frame A in FIG. 5.
Figure 9:
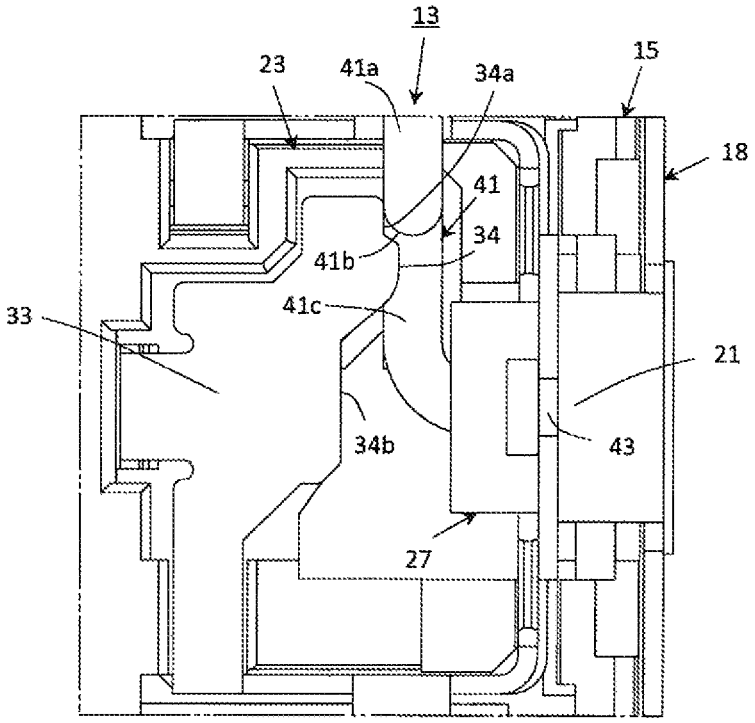
FIG. 9 is a schematic enlarged partial plan view showing an inside of a tow-dot chain line frame B in FIG. 6.
Figure 10:
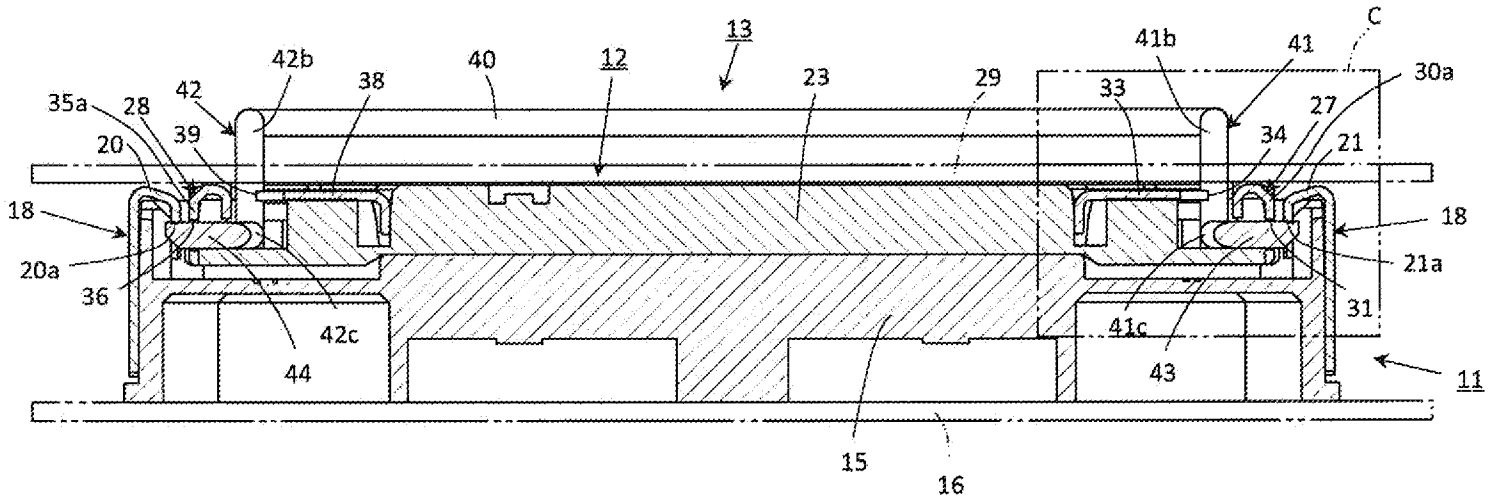
FIG. 10 is a schematic cross-sectional view taken along line X-X in FIG. 6.

In a condition wherein the receptacle type connector 11 and the plug type connector 12 are put in the mutual coupling as shown in FIGS. 5 to 7, the manipulatable member 13 mounted on the housing 23 of the plug type connector 12 to be shiftable in its position takes up the first station in which the manipulatable member 13 keeps lying down on the housing 23. As shown in FIG. 8 showing an inside of a tow-dot chain line frame A in FIG. 5, FIG. 9 showing an inside of a tow-dot chain line frame B in FIG. 6, and FIG. 10 showing a cross-section taken along line X-X in FIG. 6, the second connecting part 41*b* of the connecting portion 41 of the manipulatable member 13 is in press-contact with the first end face 34*a* included in the cam face 34 of the cam portion 33 provided on the second metallic member 27 of the plug type connector 12 to be set in its position. Similarly, the second connecting part 42*b* of the connecting portion 42 of the manipulatable member 13 is in press-contact with the first end face 39*a* included in the cam face 39 of the cam portion 38 provided on the second metallic member 28 of the plug type connector 12 to be set in its position. The manipulatable member 13 having the second connecting part 41*b* of the connecting portion 41 put in the press-contact with the first end face 34*a* included in the cam face 34 of the cam portion 33 to be set in its position and the second connecting part 42*b* of the connecting portion 42 put in the press-contact with the first end face 39*a* included in the cam face 39 of the cam portion 38 to be set in its position, is resiliently deformed by the cam portions 33 and 38 for causing the connecting portions 41 and 42 to go away from each other. Thereby, the manipulatable member 13 is operative to cause the movable locking portion 43, which extends to be bent from the connecting portion 41 and engages with the opening 31 formed on the second metallic member 27 in the plug type connector 12 for passing through the second metallic member 27 to be supported by the same, to move toward the outside of the second metallic member 27 and to cause the movable locking portion 44, which extends to be bent from the connecting portion 42 and engages with the opening 36 formed on the second metallic member 28 in the plug type connector 12 for passing through the second metallic member 28 to be supported by the same, to move toward the outside of the second metallic member 28.

Figure 11:
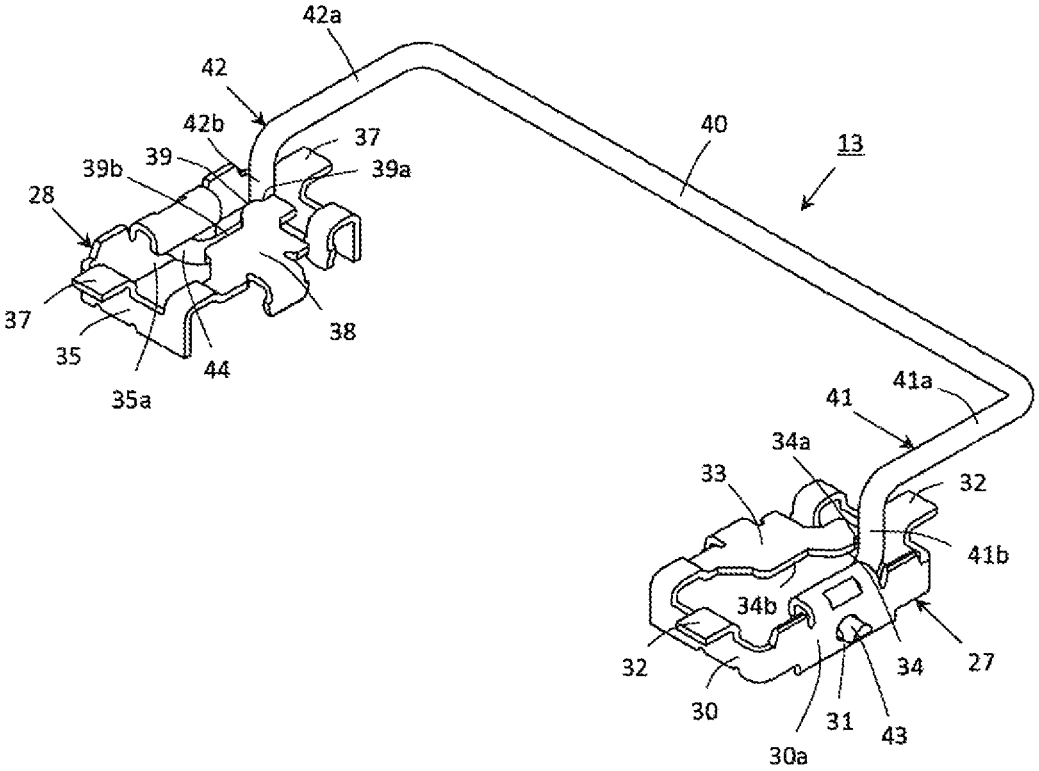
FIG. 11 is a schematic perspective view showing the second metallic members shown respectively in FIGS. 3 and 4 along with the manipulatable member shown in FIG. 1 which engages with the second metallic members and takes up the first station.

As shown in FIG. 11 which shows the second metallic members 27 and 28 along with the manipulatable member 13 engaging with the second metallic members 27 and 28 at the first station, the manipulatable member 13 which is taking up the first station and resiliently deformed by the cam portions 33 and 38 for causing the connecting portions 41 and 42 to go away from each other is operative to cause the movable locking portion 43 to project through the opening 31 to the outside of the central portion 30*a* of the ⊐-shaped body 30 of the second metallic member 27 and similarly to cause the movable locking portion 44 to project through the opening 36 to the outside of the central portion 35*a* of the ⊐-shaped body 35 of the second metallic member 28.

When the receptacle type connector 11 and the plug type connector 12 are put in the mutual coupling as described above, the central portion 30*a* of the ⊐-shaped body 30 of the second metallic member 27 in the plug type connector 12, on which the opening 31 is formed, is placed to face closely to the fixed locking portion 21 of the first metallic member 18 in the receptacle type connector 11, on which the notch 21*a* is formed, and the central portion 35*a* of the ⊐-shaped body 35 of the second metallic member 28 in the plug type connector 12, on which the opening 36 is formed, is placed to face closely to the fixed locking portion 20 of the first metallic member 18 in the receptacle type connector 11, on which the notch 20*a* is formed.

Figure 12:
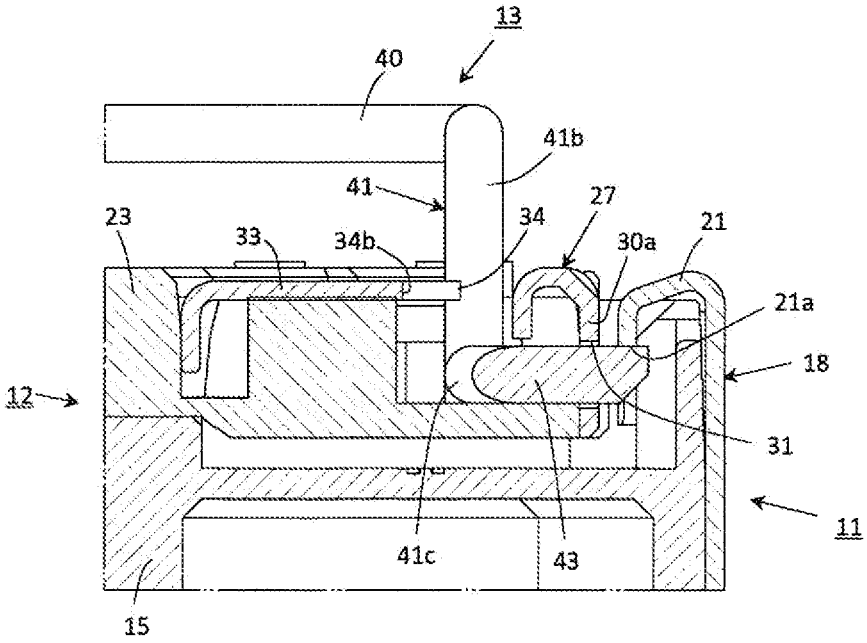
FIG. 12 is a schematic enlarged partial cross-sectional view showing an inside of a tow-dot chain line frame C in FIG. 10.

Then, when the manipulatable member 13 is caused to take up the first station in which the manipulatable member 13 keeps lying down on the housing 23 of the plug type connector 12, the movable locking portion 43 of the manipulatable member 13, which is cause to project through the opening 31 to the outside of the central portion 30*a* of the ⊐-shaped body 30 of the second metallic member 27 in the plug type connector 12 as mentioned above, is moved in the second contact-arrangement direction toward the fixed locking portion 21 of the first metallic member 18 in the receptacle type connector 11 to be put in engagement with the notch 21*a* formed on the fixed locking portion 21 so as to lock the second metallic member 27 to the first metallic member 18, as shown in FIG. 10 and FIG. 12 showing an inside of a tow-dot chain line frame C in FIG. 10, and similarly, the movable locking portion 44 of the manipulatable member 13, which is cause to project through the opening 36 to the outside of the central portion 35*a* of the ⊐-shaped body 35 of the second metallic member 28 in the plug type connector 12 as mentioned above, is moved in the second contact-arrangement direction toward the fixed locking portion 20 of the first metallic member 18 in the receptacle type connector 11 to be put in engagement with the notch 20*a* formed on the fixed locking portion 20 so as to lock the second metallic member 28 to the first metallic member 18, as shown in FIG. 10.

On that occasion, the movable locking portion 43 of the manipulatable member 13 put in the engagement with the notch 21*a* formed on the fixed locking portion 21 of the first metallic member 18 is postured to be substantially perpendicular to the central portion 30*a* of the ⊐-shaped body 30 of the second metallic member 27, as shown in FIG. 12, and the movable locking portion 44 of the manipulatable member 13 put in the engagement with the notch 20*a* formed on the fixed locking portion 20 of the first metallic member 18 is postured to be substantially perpendicular to the central portion 35*a* of the ⊐-shaped body 35 of the second metallic member 28.

Under a condition wherein the movable locking portion 43 of the manipulatable member 13 is put in the engagement with the notch 21*a* formed on the fixed locking portion 21 of the first metallic member 18 in the receptacle type connector 11 so as to lock the second metallic member 27 in the plug type connector 12 to the first metallic member 18 and the movable locking portion 44 of the manipulatable member 13 is put in the engagement with the notch 20*a* formed on the fixed locking portion 20 of the first metallic member 18 in the receptacle type connector 11 so as to lock the second metallic member 28 in the plug type connector 12 to the first metallic member 18, as described above, the housing 23 of the plug type connector 12 is put in mechanically lock to the housing 15 of the receptacle type connector 11 with the manipulatable member 13 taking up the first station, so that the mutual coupling between the receptacle type connector 11 and the plug type connector 12 is stably and firmly maintained.

Figure 13:
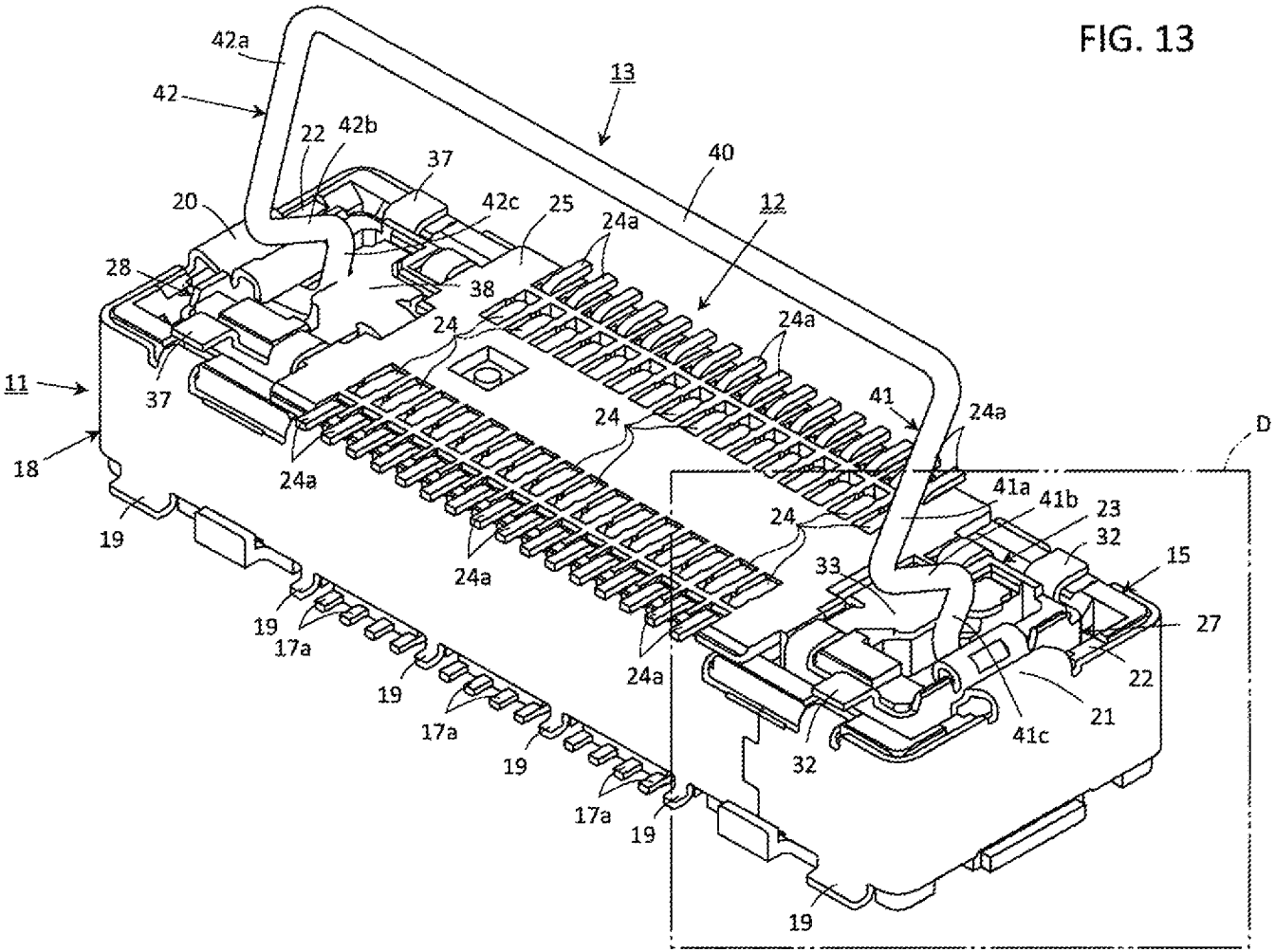
FIG. 13 is a schematic perspective view showing the embodiment of circuit-terminal connecting device according to the present invention, in which the receptacle type connector and the plug type connector are coupled with each other and the manipulatable member takes up a second station.
Figure 14:
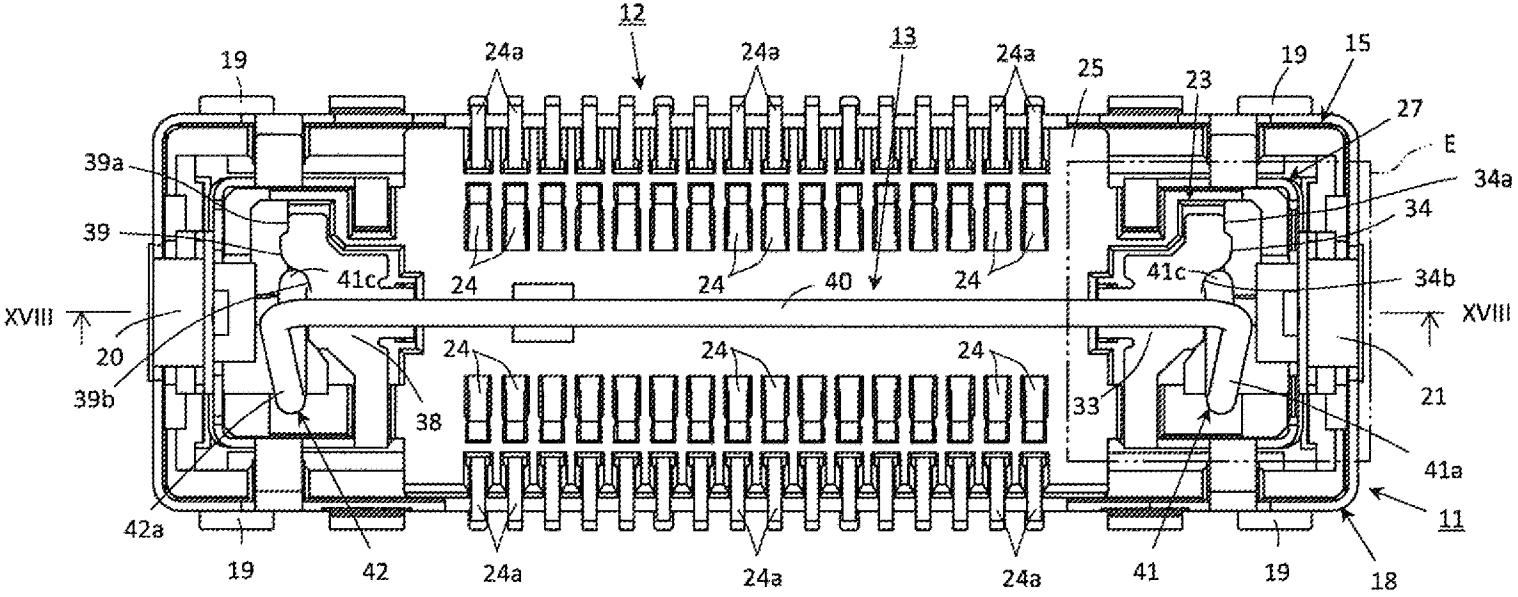
FIG. 14 is a schematic plan view showing the embodiment of circuit-terminal connecting device according to the present invention, in which the receptacle type connector and the plug type connector are coupled with each other and the manipulatable member takes up the second station.
Figure 15:
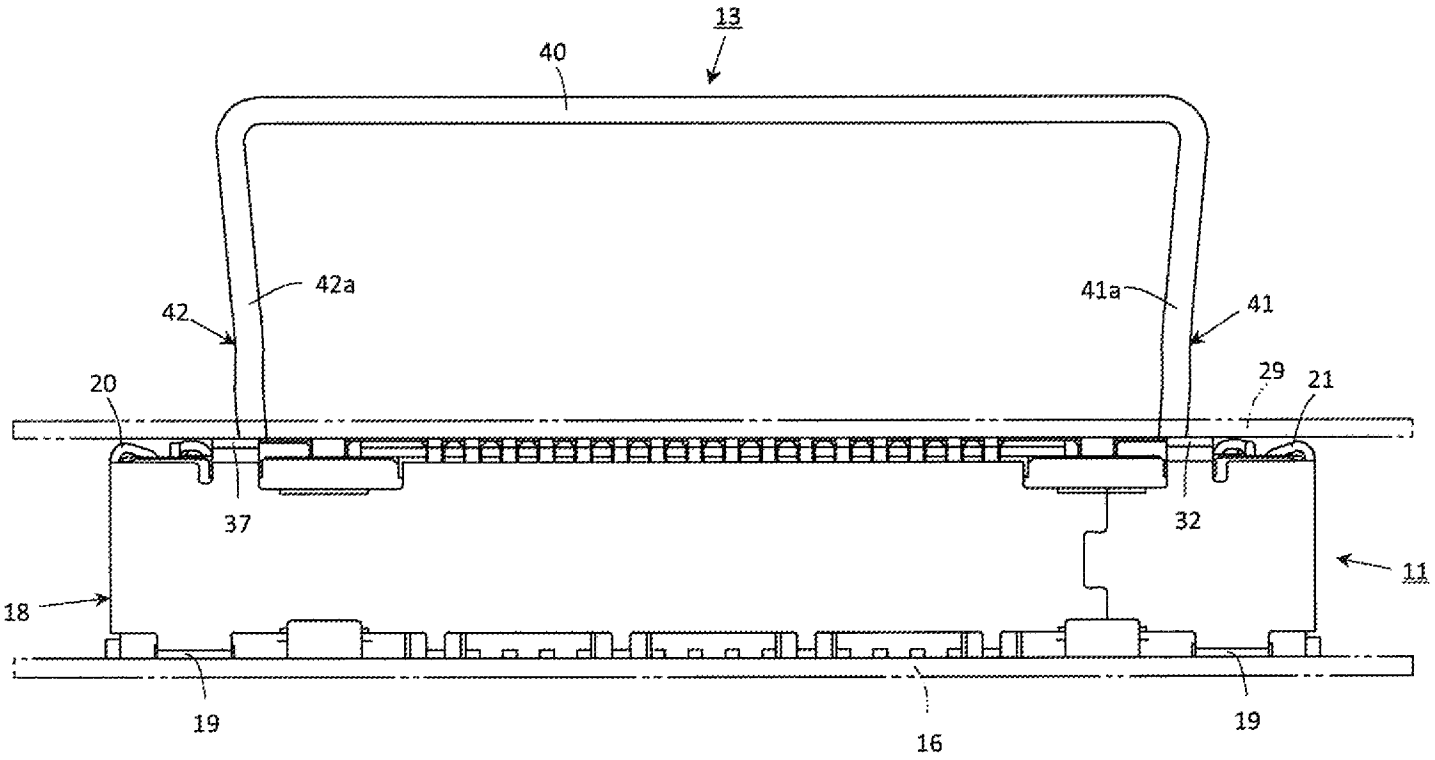
FIG. 15 is a schematic side view showing the embodiment of circuit-terminal connecting device according to the present invention, in which the receptacle type connector and the plug type connector are coupled with each other and the manipulatable member takes up the second station.

After that, when the manipulatable member 13 is shifted from the first station in which the manipulatable member 13 keeps lying down on the housing 23 of the plug type connector 12, as shown in FIGS. 5 to 7, to the second station in which the manipulatable member 13 keeps rising from the housing 23 of the plug type connector 12, as shown in FIGS. 13 to 15, the connecting portion 41 of the manipulatable member 13 is moved under guidance with the cam face 34 of the cam portion 33 provided on the second metallic member 27 in the plug type connector 12 and the connecting portion 42 of the manipulatable member 13 is moved under guidance with the cam face 39 of the cam portion 38 provided on the second metallic member 28 in the plug type connector 12.

Figure 16:
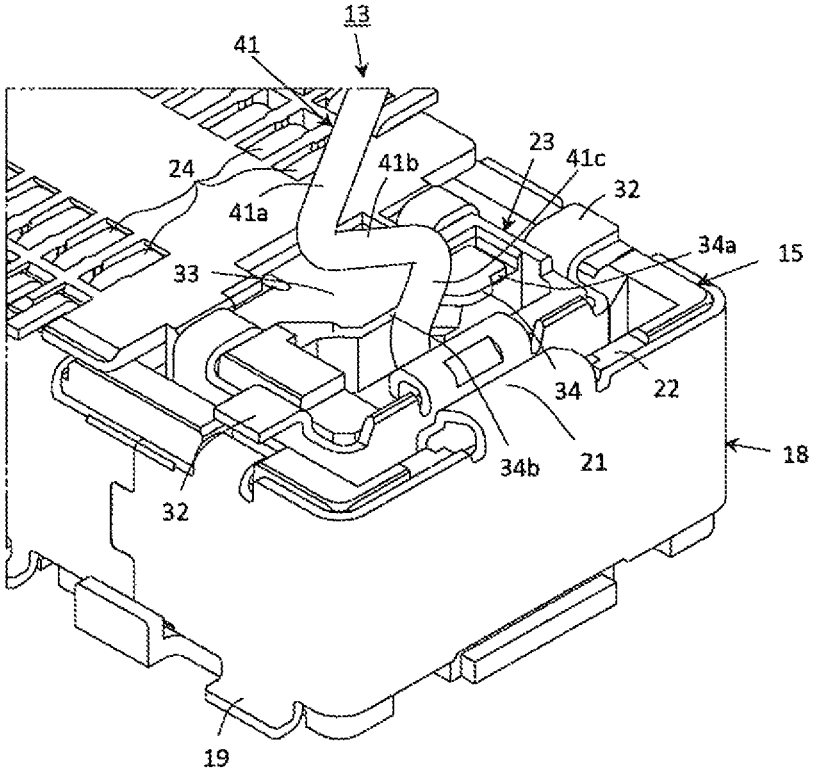
FIG. 16 is a schematic enlarged partial perspective view showing an inside of a tow-dot chain line frame D in FIG. 13.
Figure 17:
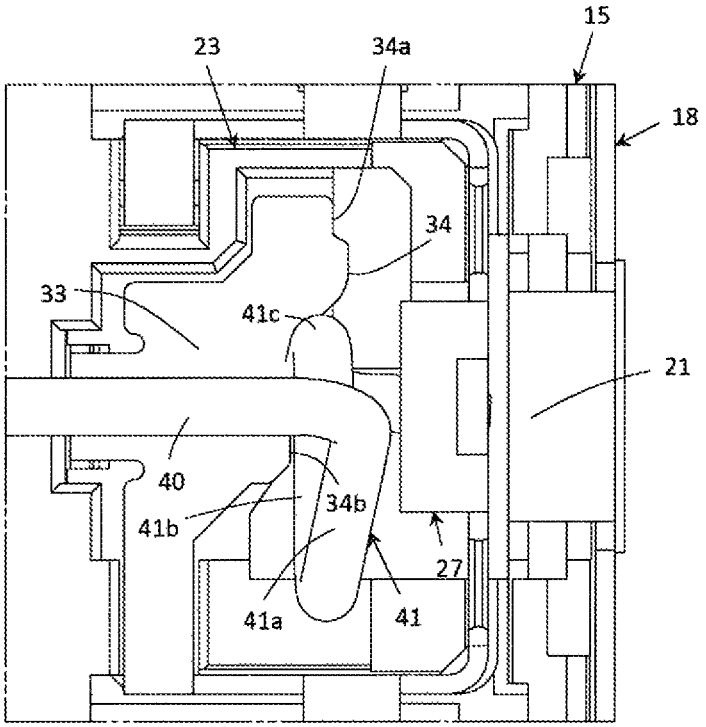
FIG. 17 is a schematic enlarged partial plan view showing an inside of a tow-dot chain line frame E in FIG. 14.
Figure 18:
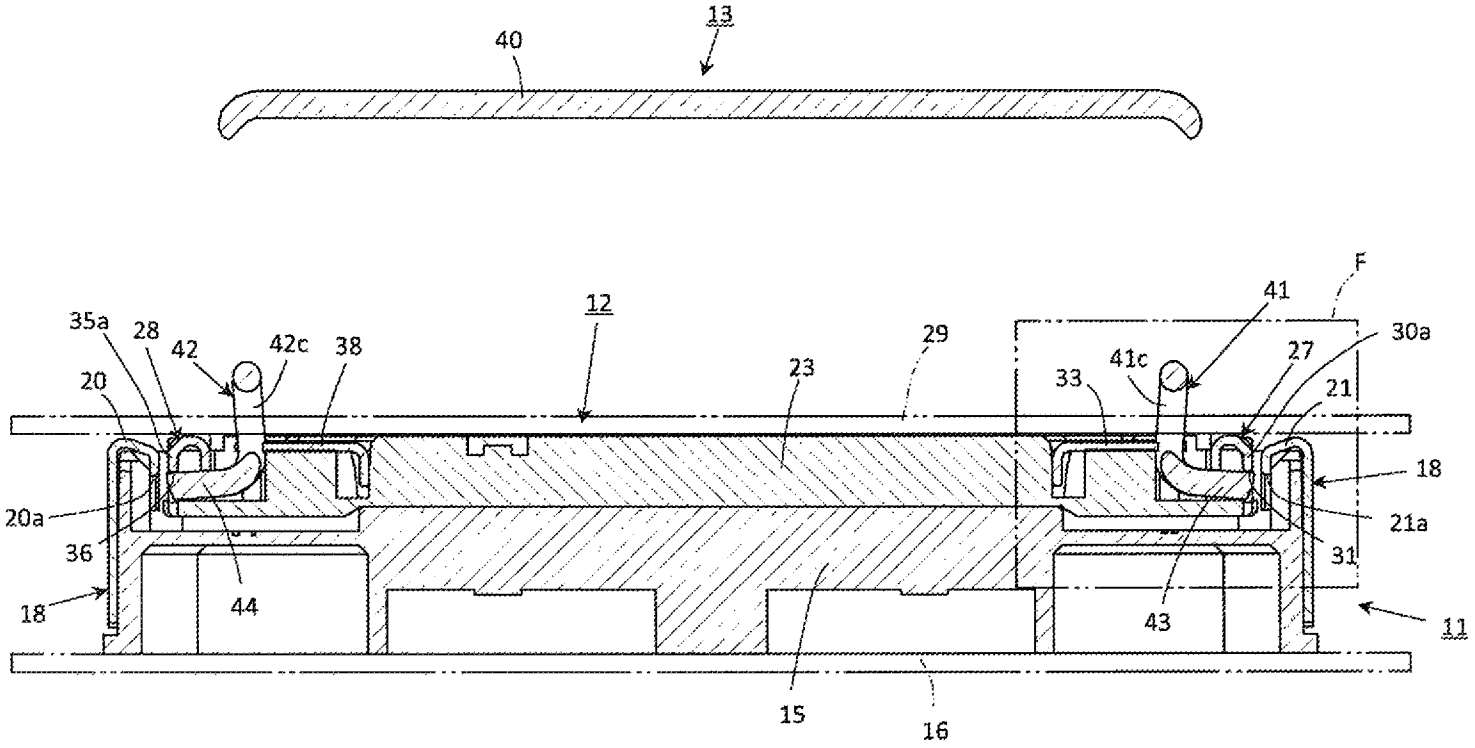
FIG. 18 is a schematic cross-sectional view taken along line XVIII-XVIII in FIG. 14.

Then, when the manipulatable member 13 has been completely shifted from the first station to the second station, the third connecting part 41*c* of the connecting portion 41 of the manipulatable member 13 is in press-contact with the second end face 34*b* included in the cam face 34 of the cam portion 33 provided on the second metallic member 27 in the plug type connector 12 to be set in its position, as shown in FIG. 16 showing an inside of a tow-dot chain line frame D in FIG. 13, FIG. 17 showing an inside of a tow-dot chain line frame E in FIG. 14, and FIG. 18 showing a cross-section taken along line XVIII-XVIII in FIG. 14. Similarly, the third connecting part 42*c* of the connecting portion 42 of the manipulatable member 13 is in press-contact with the second end face 39*b* included in the cam face 39 of the cam portion 38 provided on the second metallic member 28 in the plug type connector 12 to be set in its position. The manipulatable member 13 having the third connecting part 41*c* of the connecting portion 41 put in the press-contact with the second end face 34*b* included in the cam face 34 of the cam portion 33 to be set in its position and the third connecting part 42*c* of the connecting portion 42 put in the press-contact with the second end face 39*b* included in the cam face 39 of the cam portion 38 to be set in its position, is resiliently restored from a state of deformation by means of the cam portions 33 and 38 to the original state for causing the connecting portions 41 and 42 to come close to each other. Thereby, the manipulatable member 13 is operative to cause the movable locking portion 43, which extends to be bent from the connecting portion 41 and engages with the opening 31 formed on the second metallic member 27 in the plug type connector 12 for passing through the second metallic member 27 to be supported by the same, to move in the second contact-arrangement direction toward the inside of the second metallic member 27 and to cause the movable locking portion 44, which extends to be bent from the connecting portion 42 and engages with the opening 36 formed on the second metallic member 28 in the plug type connector 12 for passing through the second metallic member 28 to be supported by the same, to move in the second contact-arrangement direction toward the inside of the second metallic member 28.

Figure 19:
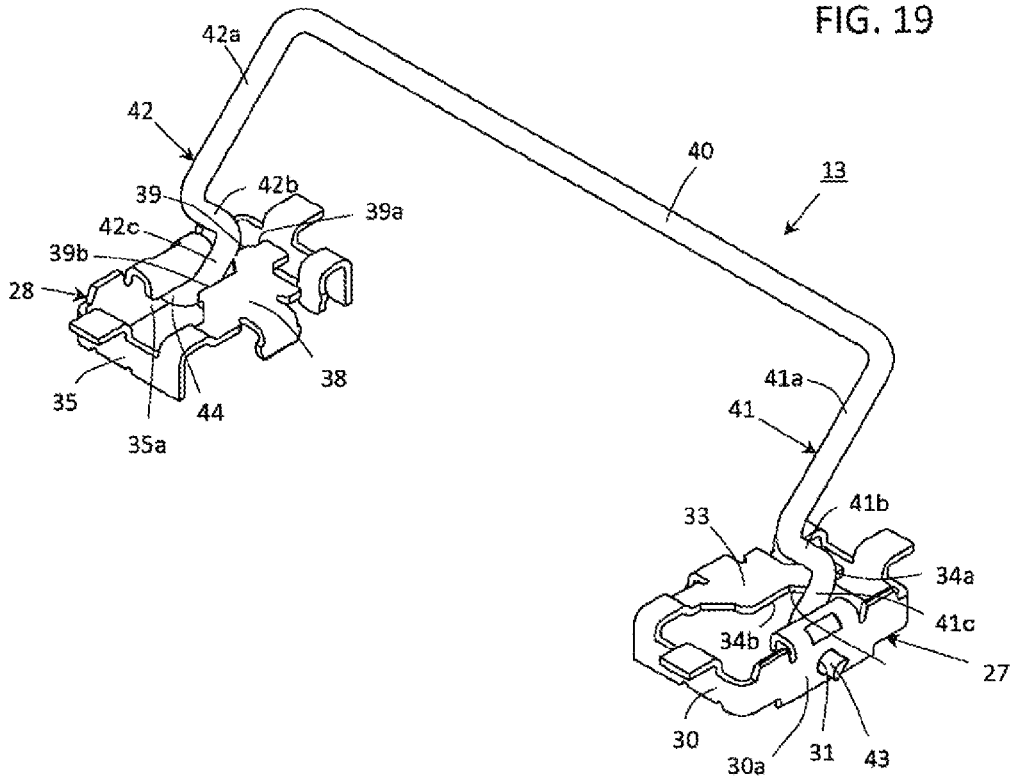
FIG. 19 is a schematic perspective view showing the second metallic members shown respectively in FIGS. 3 and 4 along with the manipulatable member shown in FIG. 1 which engages with the second metallic members and is on the way to the second station from the first station.

FIG. 19 shows the second metallic members 27 and 28 and the manipulatable member 13 which engages with the second metallic members 27 and 28 and is on the way to the second station from the first station. Further, FIG. 20 shows the second metallic members 27 and 28 and the manipulatable member 13 which engages with the second metallic members 27 and 28 and takes up the second station.

Figure 20:
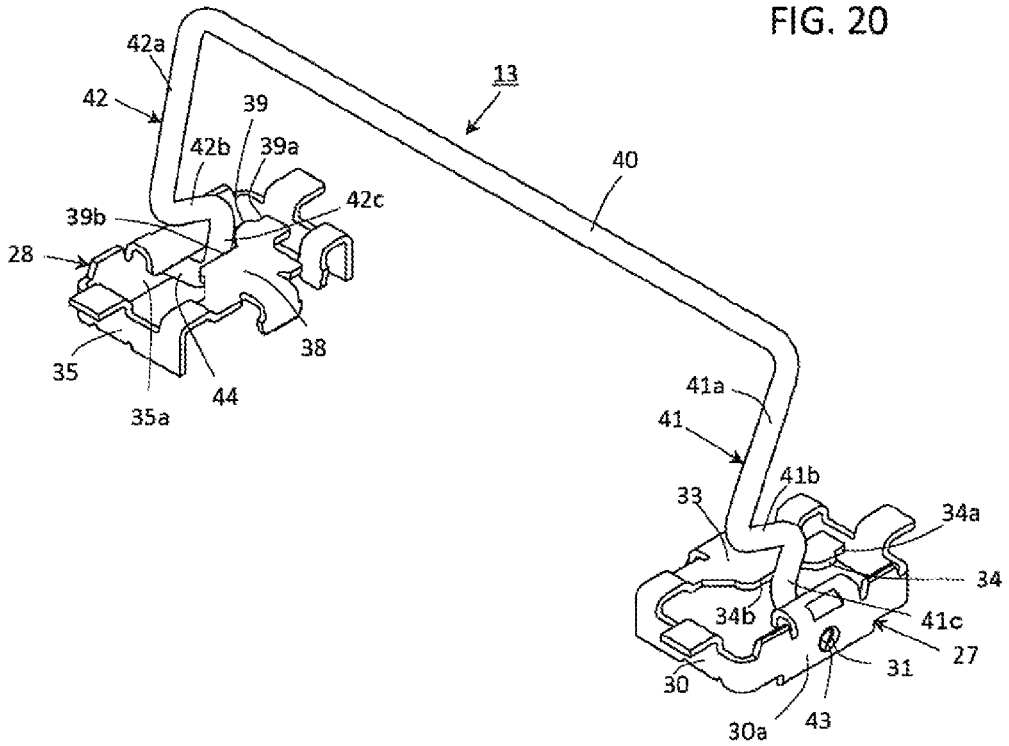
FIG. 20 is a schematic perspective view showing the second metallic members shown respectively in FIGS. 3 and 4 along with the manipulatable member shown in FIG. 1 which engages with the second metallic members and takes up the second station.

As shown in FIG. 20, the manipulatable member 13 resiliently restored to the or state not to be deformed is operative to cause the movable locking portion 43 to move through the opening 31 into the inside of the central portion 30*a* of the ⊐-shaped body 30 of the second metallic member 27 so as to go away from the fixed locking portion 21 provided on the first metallic member 18 in the receptacle type connector 11 and to cause also the movable locking portion 44 to move through the opening 36 into the inside of the central portion 35*a* of the ⊐-shaped body 35 of the second metallic member 28 so as to go away from the fixed locking portion 20 provided on the first metallic member 18 in the receptacle type connector 11.

Figure 21:
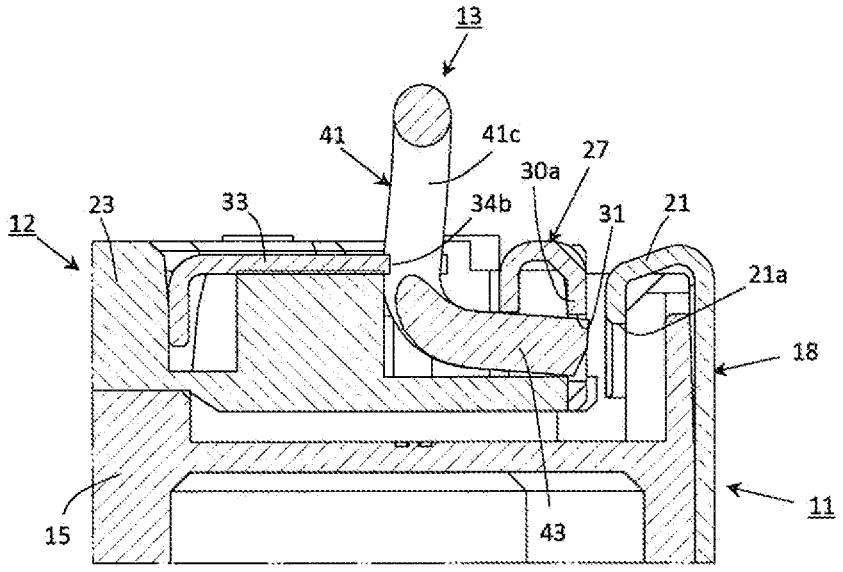
FIG. 21 is a schematic enlarged partial cross-sectional view showing an inside of a tow-dot chain line frame F in FIG. 18.

In such a manner as described above, under the condition wherein the receptacle type connector 11 and the plug type connector 12 are put in the mutual coupling, when the manipulatable member 13 is caused to take up the second station in which the manipulatable member 13 keeps rising from the housing 23 of the plug type connector 12, the movable locking portion 43 of the manipulatable member 13 which has been caused to move through the opening 31 into the inside of the central portion 30*a* of the ⊐-shaped body 30 of the second metallic member 27 so as to go away from the fixed locking portion 21 provided on the first metallic member 18 in the receptacle type connector 11, is in disengagement from the notch 21*a* formed on the fixed locking portion 21 so as to release the second metallic member 27 from a condition locked to the first metallic member 18, as shown in FIG. 18 and FIG. 21 showing an inside of a tow-dot chain line frame F in FIG. 18, and similarly, the movable locking portion 44 of the manipulatable member 13 which has been caused to move through the opening 36 into the inside of the central portion 35*a* of the ⊐-shaped body 35 of the second metallic member 28 so as to go away from the fixed locking portion 20 provided on the first metallic member 18 in the receptacle type connector 11, is in disengagement from the notch 20*a* formed on the fixed locking portion 20 so as to release the second metallic member 28 from a condition locked to the first metallic member 18, as shown in FIG. 18.

On that occasion, the movable locking portion 43 of the manipulatable member 13 put in the disengagement from the notch 21*a* formed on the fixed locking portion 21 of the first metallic member 18 is postured to slant to the central portion 30*a* of the ⊐-shaped body 30 of the second metallic member 27, as shown in FIG. 21, and the movable locking portion 44 of the manipulatable member 13 put in the disengagement from the notch 20*a* formed on the fixed locking portion 20 of the first metallic member 18 is postured to slant to the central portion 35*a* of the ⊐-shaped body 35 of the second metallic member 28.

Under a condition wherein the movable locking portion 43 of the manipulatable member 13 is put in the disengagement from the notch 21*a* formed on the fixed locking portion 21 of the first metallic member 18 in the receptacle type connector 11 so as to release the second metallic member 27 in the plug type connector 12 from the condition locked to the first metallic member 18 and the movable locking portion 44 of the manipulatable member 13 is put in the disengagement from the notch 20*a* formed on the fixed locking portion 20 of the first metallic member 18 in the receptacle type connector 11 so as to release the second metallic member 28 in the plug type connector 12 from the condition locked to the first metallic member 18, as described above, the housing 23 of the plug type connector 12 is released from the mechanical lock to the housing 15 of the receptacle type connector 11 with the manipulatable member 13 taking up the second station, so that the plug type connector 12 is able to be removed from the receptacle type connector 11.

Figure 22:
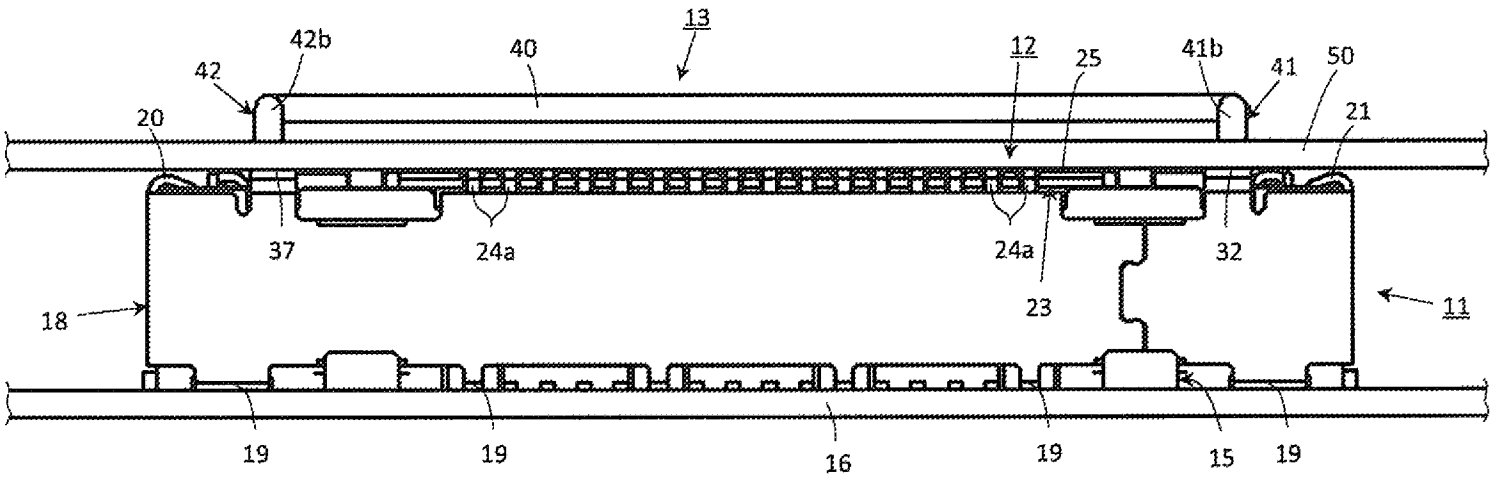
FIG. 22 is a schematic side view showing the embodiment of circuit-terminal connecting device according to the present invention along with a first circuit board to which a housing of the receptacle type connector is attached and a second circuit board to which a housing of the plug type connector is attached, wherein the receptacle type connector and the plug type connector are coupled with each other and the manipulatable member takes up the first station.

FIG. 22 shows the embodiment of circuit-terminal connecting device according to the present invention along with the first circuit board 16 having the upper surface to which the housing 15 of the receptacle type connector 11 is mounted and another second circuit board 50 having a lower surface to which the housing 23 of the plug type connector 12 is mounted, wherein the receptacle type connector 11 and the plug type connector 12 are coupled with each other so that the lower face of the second circuit board 50 faces to the upper surface of the first circuit board 16 and the manipulatable member 13 takes up the first station.

Figure 24:
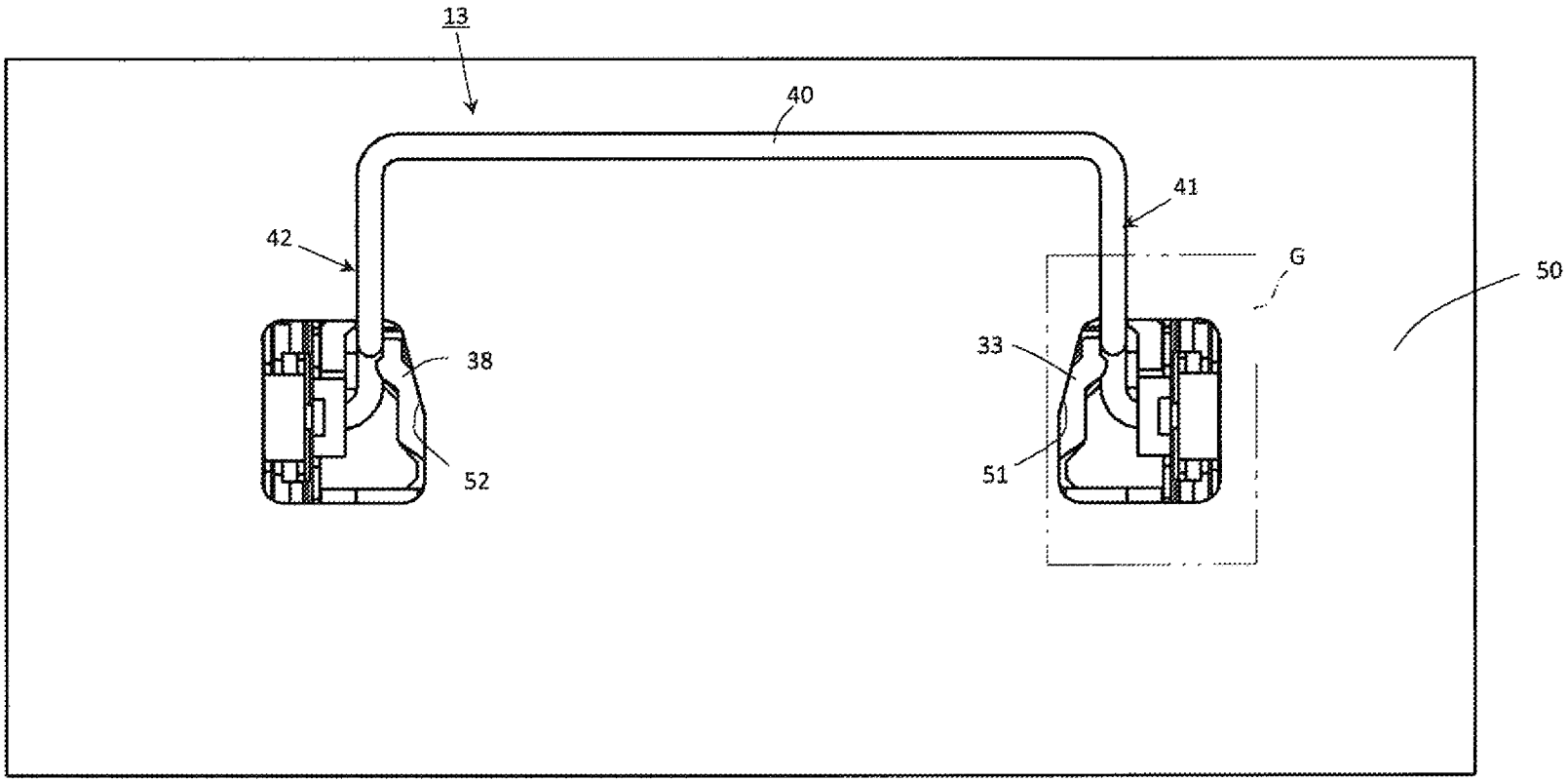
FIG. 24 is a schematic plan view showing the first circuit board to which the housing of the receptacle type connector shown in FIG. 1 is attached and the manipulatable member shown in FIG. 1 and taking up the first station.

As shown in FIGS. 23 and 24, the second circuit board 50 having the lower surface to which the housing 23 of the plug type connector 12 is mounted is provided thereon with a couple of openings 51 and 52. The opening 51 is formed on a portion of the second circuit board 50 through which the connecting portion 41 of the manipulatable member 13 passes and the opening 52 is formed on a portion of the second circuit board 50 through which the connecting portion 42 of the manipulatable member 13 passes. A situation in which the movable locking portion 43 of the manipulatable member 13 engages with each of the second metallic member in the plug type connector 12 and the fixed locking portion 21 provided on the first metallic member 18 in the receptacle type connector 11, is able to be observed through the opening 51 from the outside of an upper surface of the second circuit board 50. Similarly, a situation in which the movable locking portion 44 of the manipulatable member 13 engages with each of the second metallic member 28 in the plug type connector 12 and the fixed locking portion 20 provided on the first metallic member 18 in the receptacle type connector 11, is able to be observed through the opening 52 from the outside of the upper surface of the second circuit board 50.

The circuit-terminals 16*a* are arranged on the upper surface of the first circuit board 16 on which the housing 15 of the receptacle type connector 11 is mounted. The board connecting portion 17*a* of each of the first contacts 17 arranged on the housing 15 of the receptacle type connector 11 is connected with the corresponding one of the circuit-terminals 16*a* arranged on the upper surface of the first circuit board 16.

Figure 25:
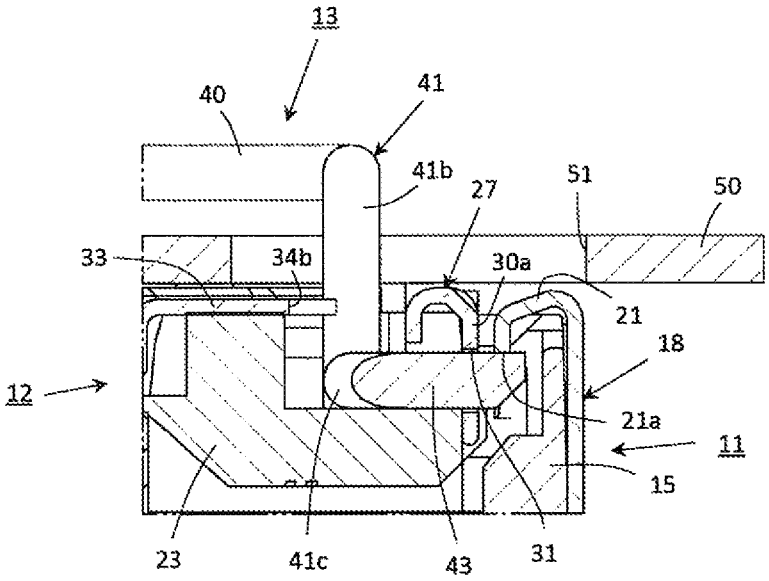
FIG. 25 is a schematic enlarged partial cross-sectional view showing portions of the receptacle type and plug type connectors coupled with each other as shown in FIG. 22 along with a movable locking portion of the manipulatable member shown in FIG. 22 put in engagement with the second metallic member shown in FIG. 3 and a fixed locking portion provided on the first metallic member shown in FIG. 2.
Figure 26:
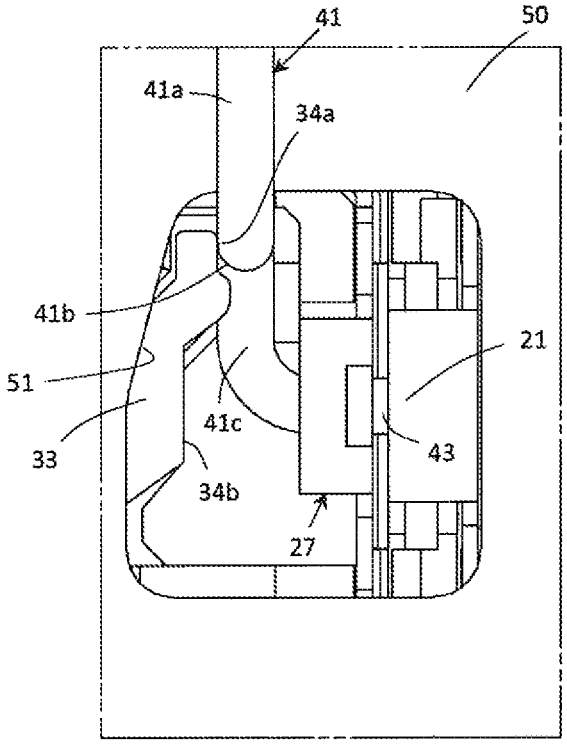
FIG. 26 is a schematic enlarged partial cross-sectional view showing an inside of a tow-dot chain line frame G in FIG. 24.

When the movable locking portion 43 of the manipulatable member 13 projects through the opening 31 to the outside of the central portion 30*a* of the ⊐-shaped body 30 of the second metallic member 27 in the plug type connector 12 to be supported by the second metallic member 27 and put in the engagement with the notch 21*a* formed on the fixed locking portion 21 of the first metallic member 18 in the receptacle type connector 11 so as to lock properly the second metallic member 27 to the first metallic member 18 as shown in FIG. 25 under the condition wherein the receptacle type connector 11 and the plug type connector 12 are put in the mutual coupling and the manipulatable member 13 takes up the first station, in the situation which is observed through the opening 51 from the outside of the upper surface of the second circuit board 50 and in which the movable locking portion 43 of the manipulatable member 13 engages with each of the second metallic member 27 in the plug type connector 12 and the fixed locking portion 21 provided on the first metallic member 18 in the receptacle type connector 11, a major part of the movable locking portion 43 of the manipulatable member 13 is obstructed by the second metallic member 27 and the fixed locking portion 21 and only a minor part of the movable locking portion 43 of the manipulatable member 13 is able to be observed between the second metallic member 27 and the fixed locking portion 21, as shown in FIG. 26 showing an inside of a tow-dot chain line frame G in FIG. 24.

Similarly, when the movable locking portion 44 of the manipulatable member 13 projects through the opening 36 to the outside of the central portion 35*a* of the ⊐-shaped body 35 of the second metallic member 28 in the plug type connector 12 to be supported by the second metallic member 28 and put in the engagement with the notch 20*a* formed on the fixed locking portion 20 of the first metallic member 18 in the receptacle type connector 11 so as to lock properly the second metallic member 28 to the first metallic member 18 under the condition wherein the receptacle type connector 11 and the plug type connector 12 are put in the mutual coupling and the manipulatable member 13 takes up the first station, in the situation which is observed through the opening 52 from the outside of the upper surface of the second circuit board 50 and in which the movable locking portion 44 of the manipulatable member 13 engages with each of the second metallic member 28 in the plug type connector 12 and the fixed locking portion 20 provided on the first metallic member 18 in the receptacle type connector 11, a major part of the movable locking portion 44 of the manipulatable member 13 is obstructed by the second metallic member 28 and the fixed locking portion 20 and only a minor part of the movable locking portion 44 of the manipulatable member 13 is able to be observed between the second metallic member 28 and the fixed locking portion 21.

Figure 27:
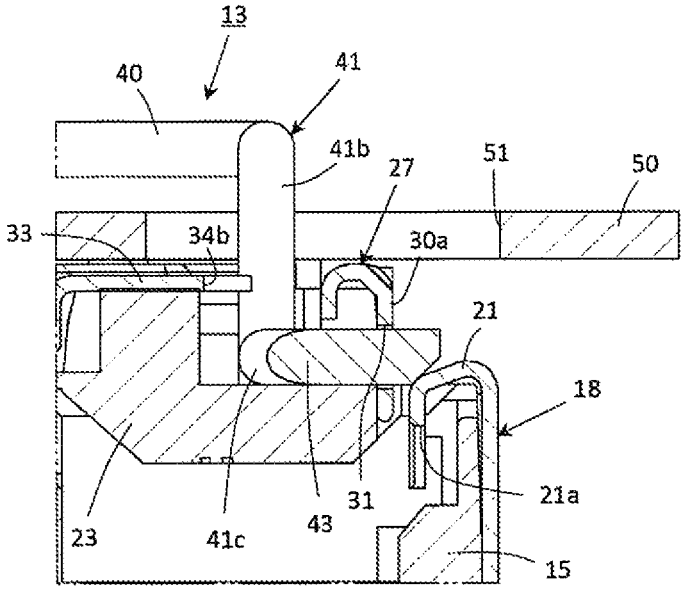
FIG. 27 is a schematic enlarged partial cross-sectional view showing the portions of the receptacle type and plug type connectors coupled with each other as shown in FIG. 22 along with the movable locking portion of the manipulatable member shown in FIG. 22 put in engagement with the second metallic member shown in FIG. 3.
Figure 28:
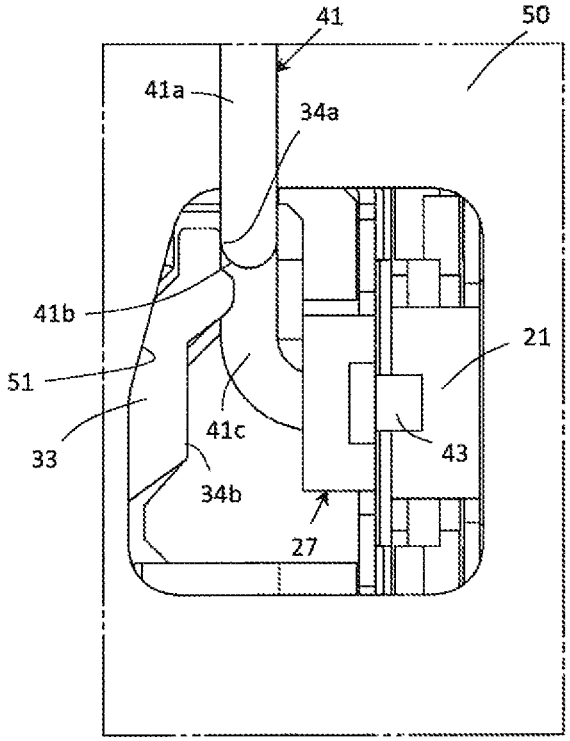
FIG. 28 is a schematic enlarged plan view showing the portions of the receptacle type and plug type connectors coupled with each other as shown in FIG. 22 along with the movable locking portion of the manipulatable member shown in FIG. 22 put in engagement with the second metallic member shown in FIG. 3.

On the other hand, When the movable locking portion 43 of the manipulatable member 13 projects through the opening 31 to the outside of the central portion 30*a* of the ⊐-shaped body 30 of the second metallic member 27 in the plug type connector 12 to be supported by the second metallic member 27 and to fail to engage with the notch 21*a* formed on the fixed locking portion 21 of the first metallic member 18 in the receptacle type connector 11 so as not to lock properly the second metallic member 27 to the first metallic member 18 as shown in FIG. 27 under the condition wherein the receptacle type connector 11 and the plug type connector 12 are put in the mutual coupling and the manipulatable member 13 takes up the first station, in the situation which is observed through the opening 51 from the outside of the upper surface of the second circuit board 50 and in which the movable locking portion 43 of the manipulatable member 13 engages with each of the second metallic member 27 in the plug type connector 12 and the fixed locking portion 21 provided on the first metallic member 18 in the receptacle type connector 11, almost a half of the movable locking portion 43 of the manipulatable member 13 is obstructed by the second metallic member 27 and the other half of the movable locking portion 43 of the manipulatable member 13 is able to be observed on the fixed locking portion 21 without being obstructed by the fixed locking portion 21, as shown in FIG. 28.

Similarly, when the movable locking portion 44 of the manipulatable member 13 projects through the opening 36 to the outside of the central portion 35*a* of the ⊐-shaped body 35 of the second metallic member 28 in the plug type connector 12 to be supported by the second metallic member 28 and to fail to engage with the notch 20*a* formed on the fixed locking portion 20 of the first metallic member 18 in the receptacle type connector 11 so as not to lock properly the second metallic member 28 to the first metallic member 18 under the condition wherein the receptacle type connector 11 and the plug type connector 12 are put in the mutual coupling and the manipulatable member 13 takes up the first station, in the situation which is observed through the opening 52 from the outside of the upper surface of the second circuit board 50 and in which the movable locking portion 44 of the manipulatable member 13 engages with each of the second metallic member 28 in the plug type connector 12 and the fixed locking portion 20 provided on the first metallic member 18 in the receptacle type connector 11, almost a half of the movable locking portion 44 of the manipulatable member 13 is obstructed by the second metallic member 28 and the other half of the movable locking portion 44 of the manipulatable member 13 is able to be observed on the fixed locking portion 20 without being obstructed by the fixed locking portion 20

Accordingly, under the condition wherein the receptacle type connector 11 having the housing 15 mounted on the upper surface of the first circuit board 16 and the plug type connector 12 having the housing 23 mounted on the lower surface of the second circuit board 50 are coupled with each other so that the lower face of the second circuit board 50 faces to the upper surface of the first circuit board 16 and the manipulatable member 13 takes up the first station, the situation in which the movable locking portion 43 of the manipulatable member 13 supported by the second metallic member 27 in the plug type connector 12 is put in the engagement with the notch 21*a* formed on the fixed locking portion 21 of the first metallic member 18 in the receptacle type connector 11 so as to lock properly the second metallic member 27 to the first metallic member 18, is able to be visually confirmed through the opening 51 formed on the second circuit board 50 from the outside of the upper surface of the second circuit board 50, and the situation in which the movable locking portion 44 of the manipulatable member 13 supported by the second metallic member 28 in the plug type connector 12 is put in the engagement with the notch 20*a* formed on the fixed locking portion 20 of the first metallic member 18 in the receptacle type connector 11 so as to lock properly the second metallic member 28 to the first metallic member 18, is also able to be visually confirmed through the opening 52 formed on the second circuit board 50 from the outside of the upper surface of the second circuit board 50.

In the embodiment of circuit-terminal connecting device according to the present invention which comprises the receptacle type connector 11, the plug type connector 12 and the manipulatable member 13, when the movable locking portion 43 of the manipulatable member 13 supported by the second metallic member 27 in the plug type connector 12 is put in the engagement with the notch 21*a* formed on the fixed locking portion 21 of the first metallic member 18 in the receptacle type connector 11 so as to lock the second metallic member 27 to the first metallic member 18 and the movable locking portion 44 of the manipulatable member 13 supported by the second metallic member 28 in the plug type connector 12 is put in the engagement with the notch 20*a* formed on the fixed locking portion 20 of the first metallic member 18 in the receptacle type connector 11 so as to lock the second metallic member 28 to the first metallic member 18, so that the housing 23 of the plug type connector 12 is put in the mechanical lock to the housing 15 of the receptacle type connector 11, the manipulatable member 13 is resiliently deformed by the cam portions 33 and 38 provided in the plug type connector 12, and when the movable locking portion 43 of the manipulatable member 13 supported by the second metallic member 27 is put in the disengagement from the notch 21*a* formed on the fixed locking portion 21 of the first metallic member 18 so as to release the second metallic member 27 from the condition locked to the first metallic member 18 and the movable locking portion 44 of the manipulatable member 13 supported by the second metallic member 28 is put in the disengagement from the notch 20*a* formed on the fixed locking portion 20 of the first metallic member 18 so as to release the second metallic member 28 from the condition locked to the first metallic member 18, so that the housing 23 of the plug type connector 12 is released from the mechanical lock to the housing 15 of the receptacle type connector 11, the manipulatable member 13 is resiliently restored from the state of deformation by means of the cam portions 33 and 38 to the original state. That is, when the housing 23 of the plug type connector 12 is put in the mechanical lock to the housing 15 of the receptacle type connector 11, the manipulatable member 13 having the movable locking portions 43 and 44 at its ends is resiliently deformed to force the movable locking portions 43 and 44 to engage with the fixed locking portions 21 and 20, respectively.

Accordingly, even if a locked state in which the housing 23 of the plug type connector 12 is put in the mechanical lock to the housing 15 of the receptacle type connector 11 and an unlocked state in which the housing 23 of the plug type connector 12 is released from the mechanical lock to the housing 15 of the receptacle type connector 11 are taken repeatedly, the movable locking portions 43 and 44 at the ends of the manipulatable member 13 are able to engage properly and surely with the fixed locking portions 21 and 20 provided on the first metallic member 18 of the receptacle type connector 11, respectively, so that the housing 23 of the plug type connector 12 is mechanically locked surely and reliably to the housing 15 of the receptacle type connector 11.

Further, in the embodiment of circuit-terminal connecting device according to the present invention which comprises the receptacle type connector 11, the plug type connector 12 and the manipulatable member 13, the movable locking portions 43 and 44 at the ends of the manipulatable member 13 are operative to pass through respectively the second metallic members 27 and 28 in the plug type connector 12 to be supported respectively by the second metallic members 27 and 28 and the first metallic member 18 in the receptacle type connector 11 is provided thereon with the fixed locking portions 20 and 21, so that the movable locking portions 43 and 44 of the manipulatable member 13 are supported respectively by the second metallic members 27 and 28 each having relatively large stiffness to engage respectively with the fixed locking portions 21 and 20 provided on the first metallic member 18 also having relatively large stiffness. Accordingly, even if a thickness of each of the housing 15 of the receptacle type connector 11 and the housing 23 of the plug type connector 12 is reduces for miniaturization and reduction in weight of each of the receptacle type connector 11 and the plug type connector 12, the movable locking portions 43 and 44 of the manipulatable member 13 are able to be put in firm engagement with the fixed locking portions 21 and 20 provided on the first metallic member 18, respectively, so that the housing 23 of the plug type connector 12 is mechanically locked stably and reliably to the housing 15 of the receptacle type connector 11.

Besides, with the embodiment of circuit-terminal connecting device according to the present invention which comprises the receptacle type connector 11, the plug type connector 12 and the manipulatable member 13, for causing the movable locking portions 43 and 44 of the manipulatable member 13 to disengage respectively from the fixed locking portions 21 and 20 provided on the first metallic member 18 so that the housing of the plug type connector 12 is released from the mechanical lock to the housing 15 of the receptacle type connector 11, it is required only to shift the manipulatable member 13 from the first station in which the manipulatable member 13 keeps lying down on the housing 23 of the plug type connector 12 to the second station in which the manipulatable member 13 keeps rising from the housing 23 of the plug type connector 12. Accordingly, the housing 23 of the plug type connector 12 is able to be surely released from the mechanical lock to the housing 15 of the receptacle type connector 11 by means of simple and easy manipulation without using any specified tool or the like.

The invention claimed is:

1. A circuit-terminal connecting device for connecting electrically first circuit-terminals provided on a first circuit board with second circuit-terminals provided on a second circuit board, which comprises a first electrical connector having a first housing attached to the first circuit board, a plurality of first contacts arranged on the first housing to be connected with the first circuit-terminals, and a first metallic member fixed to the first housing;

a second electrical connector having a second housing attached to the second circuit board and operative to engage with the first housing, a plurality of second contacts arranged on the second housing to be connected with the second circuit-terminals for coming into press-contact with the first contacts when the second housing is put in engagement with the first housing, so that the second circuit-terminals are electrically connected with the first circuit-terminals through the first and second electrical connectors, and a second metallic member attached to the second housing; and a manipulatable member shaped into a bent rod and mounted on the second housing to be shiftable in its position for being in selectively a first position in which the manipulatable member lies down on the second housing and a second position in which the manipulatable member rises from the second housing, wherein each of end portions of the manipulatable member opposite to each other is formed into a movable locking portion operative to pass through the second metallic member to be supported by the second metallic member, wherein the first metallic member is provided thereon with a pair of fixed locking portions, wherein the manipulatable member is shifted under guidance with a cam portion provided in the second electrical connector to be resiliently deformed for causing the movable locking portions to engage respectively with the fixed locking portions so that the second housing is put in mechanical lock to the first housing when the second housing is put in engagement with the first housing and the manipulatable member is in the first position, and wherein the manipulatable member is resiliently restored from a state of deformation by means of moving the cam portion to an original state for causing the movable locking portions to disengage respectively from the fixed locking portions so that the second housing is released from the mechanical lock to the first housing when the second housing is put in the engagement with the first housing and the manipulatable member is in the second position.

2. A circuit-terminal connecting device according to claim 1, wherein the cam portion provided in the second electrical connector is configured as a part of the second metallic member.

3. A circuit-terminal connecting device according to claim 1, wherein each of the movable locking portions supported by the second metallic member moves in one of first and second directions opposite to each other to engage with the fixed locking portion when the manipulatable member is shifted from the second position to the first position and then moves in the other of the first and second directions to disengage from the fixed locking portion when the manipulatable member is shifted from the first position to the second position under a condition wherein the second housing is put in engagement with the first housing.

4. A circuit-terminal connecting device according to claim 1, wherein the second metallic member is provided with a supporting portion through which the movable locking portion at the end of the manipulatable member passes to be supported by the supporting portion and which is placed to face closely to a portion of the first metallic member on which the fixed locking portion is provided under a condition wherein the second housing is put in engagement with the first housing.

5. A circuit-terminal connecting device according to claim 4, wherein the second metallic member is configured to be a couple of separated members each provided thereon with the supporting portion and the supporting portions provided respectively on the separated members are opposite to each other in a direction along which the second contacts are arranged on the second housing with the second contacts between the supporting portions.

6. A circuit-terminal connecting device according to claim 5, wherein the manipulatable member has a middle portion extending in the direction along which the second contacts are arranged on the second housing, a pair of connecting portions extending to be bent respectively from both ends of the middle portion, and end portions extending respectively from the connecting portions to constitute respectively the movable locking portions, and each of the movable locking portions is moved in the direction along which the second contacts are arranged on the second housing when the manipulatable member is caused to shift from one to the other of the first and second positions under a condition wherein the second housing is put in engagement with the first housing.

7. A circuit-terminal connecting device according to claim 6, wherein a cam face with which the connecting portion of the manipulatable member is in press-contact is provided on the second metallic member and the connecting portion of the manipulatable member is moved under guidance with the cam face so as to cause the movable locking portion to be moved in the direction along which the second contacts are arranged on the second housing when the manipulatable member is caused to shift from one to the other of the first and second positions under the condition wherein the second housing is put in engagement with the first housing.

8. A circuit-terminal connecting device according to claim 7, wherein movements of the each of the movable locking portions at the end of the manipulatable member in the direction along which the second contacts are arranged on the second housing is brought about by resiliency of the manipulatable member.

9. A circuit-terminal connecting device according to claim 1, wherein a situation in which each of the movable locking portions at the end of the manipulatable member engages with the second metallic member and the fixed locking portion provided on the first metallic member is able to be observed through an opening formed on the second circuit board from the outside of the second circuit board under a condition wherein the second housing is put in engagement with the first housing.

10. A circuit-terminal connecting device according to claim 9, wherein each of the connecting portions of the manipulatable member is positioned to pass through a portion of the second circuit board at which the opening is formed.

* * * * *